US005608363A

United States Patent [19]

Cameron et al.

[11] Patent Number: 5,608,363

[45] Date of Patent: Mar. 4, 1997

[54] FOLDED SINGLE MODE DIELECTRIC RESONATOR FILTER WITH CROSS COUPLINGS BETWEEN NON-SEQUENTIAL ADJACENT RESONATORS AND CROSS DIAGONAL COUPLINGS BETWEEN NON-SEQUENTIAL CONTIGUOUS RESONATORS

[75] Inventors: Richard J. Cameron, Bucks, United Kingdom; Wai-Cheung Tang, Mannheim; Van Dokas, Cambridge, both of Canada

[73] Assignee: COM DEV Ltd., Cambridge, Canada

[21] Appl. No.: 221,947

[22] Filed: Apr. 1, 1994

[51] Int. Cl.[6] ..... H01P 1/201

[52] U.S. Cl. ..... 333/202; 333/219.1; 333/230

[58] Field of Search ..... 333/202, 208–212, 333/219.1, 230

[56] References Cited

U.S. PATENT DOCUMENTS

| | | | |
|---|---|---|---|
| 3,715,690 | 2/1973 | Young et al. | 333/202 X |
| 3,737,816 | 6/1973 | Honicke | 333/209 X |
| 4,291,288 | 9/1981 | Young et al. | 333/212 |
| 4,453,146 | 6/1984 | Fiedziuszko | 333/212 |
| 4,477,785 | 10/1984 | Atia | 333/202 |
| 4,721,933 | 1/1988 | Schwartz et al. | 333/209 X |
| 4,821,006 | 4/1989 | Ishikawa et al. | 333/202 |
| 4,890,078 | 12/1989 | Radcliffe | 333/230 X |
| 5,220,300 | 6/1993 | Synder | 333/230 X |

FOREIGN PATENT DOCUMENTS

| | | | |
|---|---|---|---|
| 1942909 | 3/1971 | Germany | 333/212 |
| 2161792 | 6/1973 | Germany | 333/203 |
| 0103655 | 8/1979 | Japan | 333/212 |

OTHER PUBLICATIONS

Cameron, R. J.; "General Prototype Network–Synthesis Methods for Microwave Filters"; *ESA Journal* 1982, vol. 6; pp. 193–206.

*Primary Examiner*—Benny Lee
*Attorney, Agent, or Firm*—Daryl W. Schnurr

[57] ABSTRACT

The invention relates to a single mode multi-cavity microwave filter that includes a housing formed with a plurality of walls which define at least two rows of side-by-side dielectric loaded cavities, wherein sequential cavities are coupled to one another via slots formed in the walls therebetween and at least one pair of non-sequential adjacent cavities are coupled via a probe. The coupling via the slots is defined mathematically as positive coupling. The probe is selectively configurable to provide positive or negative coupling relative to the sign of the slot coupling. Further, at least one non-adjacent, non-sequential pair of cavities is coupled via a second probe that may be configured to provide either positive or negative coupling relative to the sign of the slot coupling. The filter housing supports a plurality of adjustable fins which extend into the slots, one fin to each slot, to selectively adjust the size of the slot.

12 Claims, 27 Drawing Sheets

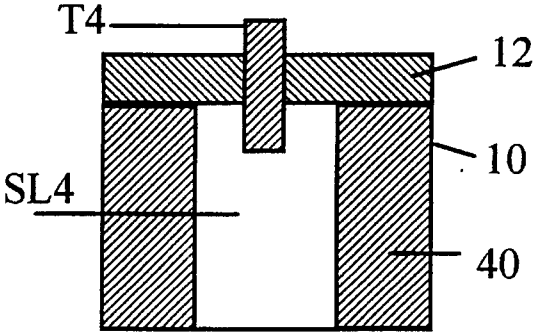
FIGURE 4A
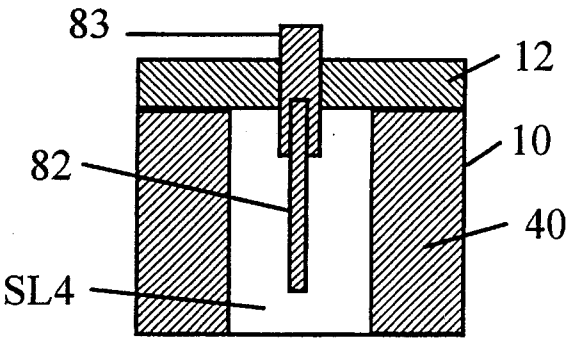
FIGURE 4B
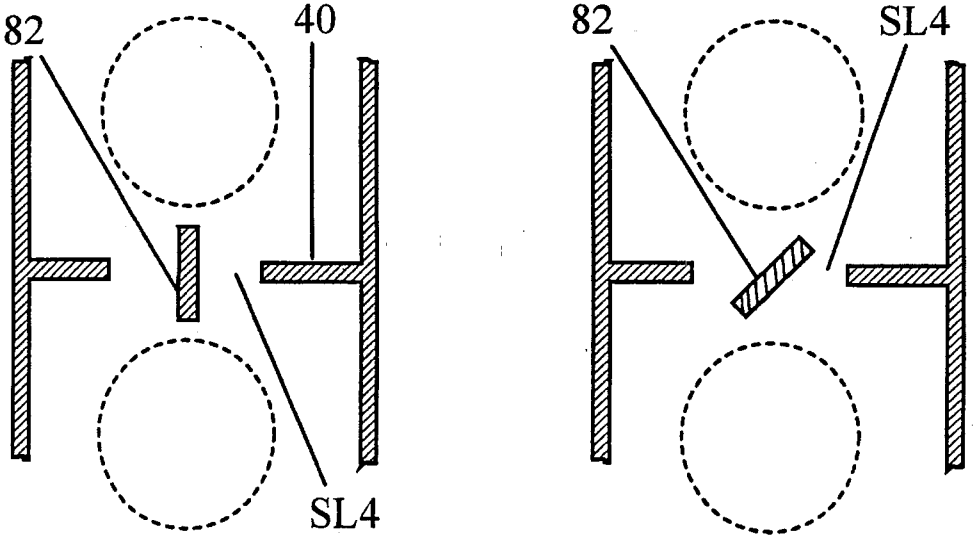
FIGURE 4C
FIGURE 4D
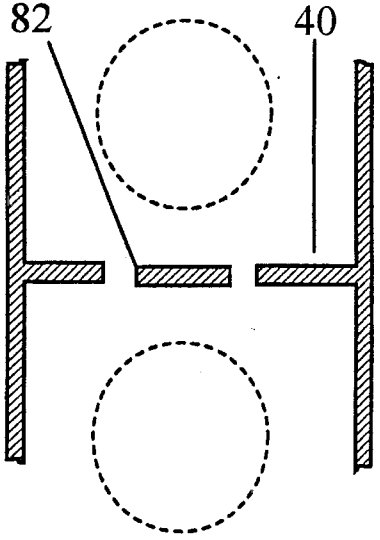
FIGURE 4E

FOLDED SINGLE MODE DIELECTRIC RESONATOR FILTER WITH CROSS COUPLINGS BETWEEN NON-SEQUENTIAL ADJACENT RESONATORS AND CROSS DIAGONAL COUPLINGS BETWEEN NON-SEQUENTIAL CONTIGUOUS RESONATORS

BACKGROUND OF THE INVENTION

The invention relates to a single mode dielectric resonator microwave filter for use primarily in electronic communications, such as in a communications satellite. More specifically, the present invention relates to a multi-cavity microwave filter.

DESCRIPTION OF THE PRIOR ART

Multi-cavity microwave filters are used in communication satellites, particularly those that are launched into geosynchronous orbit for communications with ground stations. A plurality of filters are used in a typical satellite, each filter able to separate and isolate a specific signal or frequency bandwidth from all of the signals and frequencies transmitted to the satellite. After separation, each signal is amplified to strengthen the signal, whereafter, the amplified signals are transmitted back to ground stations. A single satellite may be equipped with twenty to sixty such filters, depending on its mission.

A group of microwave filters developed during and since World War II are referred to as waveguide or cavity filters. These filters are hollow structures and are sized to resonate at specific frequency bandwidths in response to microwave signals communicated to the filter structures. A cavity resonates using a specific mode. Various modes have been defined over the years by the I.E.E.E. The resonant mode dominant in a filter is dependant upon the geometry of the filter structure. Filters which resonate using one mode only are referred to as single mode filters. In recent years, dielectric resonators have been introduced into cavity resonator structures, in part to improve output response and reduce the size of the cavity. Cavities with dielectric resonators are often referred to in the art as "loaded" cavities.

Multiple cavity filters have also been developed in recent years. One such filter is described in U.S. Pat. No. 5,220,300 to Snyder wherein a series of linearly arranged cavities are each loaded with a dielectric resonator. The wall formed between each pair of adjacent cavities is provided with a sized iris (or opening). Each iris provides a means for coupling magnetic energy between adjacent resonators. Further, a tuning screw partially extends into each iris for tuning the iris coupling. Unfortunately, the linearly arranged filter design may not provide the desired bandpass output necessary for some satellite communication applications.

There have also been numerous attempts at building dual mode filters, where either a cavity structure or a loaded cavity structure is designed to resonate using two modes or "dual modes". One such filter is disclosed in U.S. Pat. No. 3,697,898 to Blachier et al. The '898 patent discloses a multi-cavity filter comprising an elongated cylinder. Planar walls formed within the cylinder define a plurality of cylindrical cavities. Each cavity is coupled to adjacent cavities via a specifically sized iris formed in the wall therebetween. The '898 filter design, has several drawbacks.

For instance, in a communications satellite, a typical desired output from a microwave filter includes a high degree of linearity for the amplitude of the passband frequency range (the desired output) and linearity for the group delay response, in order to minimize distortion in the signal passing through the filter, while maintaining high rejection slopes flanking the filter passband. Dual mode filters typically require external equalization to achieve the desired performance. External equalization necessitates the use of ferrite coupling circulators, thus incurring the mass and volume penalty associated with such devices.

Dual mode filters typically require one coupling screw for each resonator to properly couple the two modes and two tuning screws cavity, one tuning screw to tune each resonant mode. A fair amount of time is required for proper tuning of each filter in order to get the desired frequency bandwidth output.

In a communications satellite, a plurality of filters are employed. Each filter must be built and tuned to provide a specific frequency bandwidth output. Mass production of such filters is desirable, but difficult to achieve. For instance, multi-cavity filters which employ iris coupling, typically require each iris to be custom sized to ensure propagation of the desired mode and/or frequency bandwidth output, thus complicating the manufacturing process.

A mathematical analysis of a microwave filter typically yields a series of mathematical equations which are representative of the idealized configuration of the filter. For instance, the couplings between sequential adjacent cavities and the resonators therein, are assigned a sign, positive or negative, for mathematical and theoretical purposes. Knowing the relative sign of each coupling in a filter is important in terms of predicting the output of the filter, such as the frequency bandwidth, the insertion loss, etc.

For most practical applications it is desirable to attenuate as strongly as possible unwanted signals which may exist very close to the edges of the usable bandwidth output of each filter. In an attempt to provide better attenuation, cross-coupled filters have been attempted in the past. In such attempts, non-adjacent and non-sequential cavities within a filter structure have been coupled.

One form of a cross-coupled dielectric resonator filter is described in an article entitled "Generalized Dielectric Resonator Filters" by A. E. Atia and R. R. Bonetti, Comsat Technical Review Vol. II, No. 2, 1981, pp 321–343. The article describes a folded filter formed with a plurality of cavities therein. The folded structure includes two rows of cavities, the first row having cavities 1 through n, and the second row having cavities n+1 through 2n. The folded structure is such that cavity 1 is adjacent to cavity 2n, cavity 2 is adjacent to cavity 2n–1, . . . and cavity n is adjacent to cavity n+1. The bottoms of adjacent cavities are covered with striplines, each stripline common to at least two cavities. A stripline is typically an elongated flat strip of, for instance, a conductive metal. In some applications, a stripline is formed directly on a substrate in a manner similar to the manufacture of a circuit board or the like. In the Atia el al. publication, a dielectric resonator is disposed in each cavity, and is isolated from the stripline by a dielectric support. In these filters, coupling is obtained between the resonators by means of the stripline whose ends are positioned under the resonators. The sign (positive or negative, in a mathematical sense) of each coupling is determined by the length of the stripline such that each multiple of a quarter wavelength changes the sign of coupling. For instance, if a quarter wavelength stripline represents a positive coupling, then half a wavelength stripline represents a negative coupling and a three-quarter wavelength stripline represents a positive coupling.

The publication entitled "General Prototype Network-Synthesis Methods For Microwave Filters" by R. J. Cameron, published in the ESA Journal 1982, Volume 6, pages 193–206, discloses a variation of the stripline coupling disclosed by Atia and Bonetti. The filter disclosed in the Cameron article has a folded structure similar to the structure disclosed in the Atia and Bonetti article. However, in Cameron, there are two rows of cylindrically shaped, resonator loaded cavities offset from one another such that each cavity is adjacent to as many as two non-sequential cavities. For instance, cavity 1 is adjacent to cavities 7 and 8, cavity 2 is adjacent to cavities 6 and 7 and so on. Each cavity in the filter is coupled to adjacent sequential cavities by a stripline. Each cavity is further coupled to as many as two adjacent, non-sequential cavities via further striplines. For instance, cavities 1 and 8 are coupled via a stripline in contact with the resonator in each cavity. Cavities 1 and 7 are coupled via another stripline in contact with the resonator in each cavity. Cavities 2 and 7 are coupled via a stripline in contact with the resonator in each cavity. Cavities 2 and 6 are coupled via a stripline in contact with the resonator in each cavity, and so on. The coupling between non-sequential cavities is referred to as diagonal cross-coupling. The sign of the coupling (in a mathematical sense) is, as above, determined by the length of the stripline and further may be changed by twisting a portion of a flat stripline 180 degrees thus forming a partial loop in the stripline. Since striplines are usually formed on a substrate, twisting of the stripline is not practical in manufacturing methods, since the substrate would necessarily have to be partially removed from the stripline in order to twist it.

Another example of cross coupling is disclosed in U.S. Pat. No. 2,749,523 which discloses a non-dielectric resonator filter in which negative coupling is provided between at least two resonators. At least three juxtaposed cavities are coupled in series via irises. The inlet and outlet irises of each cavity are located either on two opposite walls or else on two perpendicular walls, with the cavities being connected sequentially in series. A cable, or waveguide having a probe at each end provides coupling between non-sequential cavities in the series of cavities.

SUMMARY OF THE INVENTION

The invention relates to a single mode microwave filter having a unitary multi-cavity housing formed with a plurality of walls defining a plurality of cavities, that are sequentially oriented in first and second side-by-side rows, each row having a plurality of cavities. A cylindrically shaped dielectric resonator is supported within each of the cavities. The wall between each of any two adjacent sequential cavities is provided with a slots to couple adjacent sequential resonators. An input device is disposed adjacent to and connected to a first cavity in the first row, and an output device is disposed adjacent to and connected to a cavity in the second row.

A probe is positioned in the wall between at least two non-sequential adjacent cavities, one cavity in the first row and the other cavity in the second row thus cross coupling said two non-sequential cavities, the probe having opposite ends each of which extends in a direction generally parallel to the curvature of the cylindrically shaped resonators.

In one embodiment of the present invention, the probe ends are symmetrical about the wall between the non-sequential adjacent cavities. Further, the coupling accomplished by the slots formed in the walls is defined mathematically as positive, and the coupling accomplished by the symmetrical probe ends of the probe is defined mathematically as negative.

In another embodiment of the present invention, the probe ends are asymmetrical about the wall between the non-sequential adjacent cavities. Further, in this embodiment, the slot couplings are defined mathematically as positive and the coupling by the asymmetrical probe ends of the probe is defined mathematically as positive.

In yet another embodiment, the filter may include four contiguous cavities wherein a probe having opposite probe ends is disposed in the walls defining the four contiguous cavities such that the probe ends extend into two non-sequential, non adjacent cavities of the four contiguous cavities to couple radiant energy therebetween.

The invention further relates to a single mode dielectric resonator filter capable of selectively providing arbitrary amplitude and group delay response via a combination of cross couplings between non-sequential adjacent resonators and cross diagonal couplings between non-sequential contiguous resonators. The cross diagonal coupling may be utilized to pre-distort the filter to compensate for the distortion caused by the dispersion characteristics of dielectric loaded cavities.

BRIEF DESCRIPTION OF THE DRAWINGS

Some advantages of the disclosed invention will become apparent from a reading of the following description when read in conjunction with the accompanying drawings in which:

FIG. 4A is a partial section of the filter depicted in FIG. 1 taken along the line 4A—4A, looking in the direction of the arrows, depicting an adjusting screw used for adjusting the resonator coupling slots between adjacent, sequential cavities;

FIG. 4B is a partial section similar to FIG. 4A, depicting an alternate method of tuning the coupling slots using an adjustable fin;

FIGS. 4C, 4D and 4E are top fragmentary views of the portion of the filter shown in FIG. 4B depicting positions of the adjustable tuning fin shown in FIG. 4B;

DETAILED DESCRIPTION OF THE DRAWINGS AND PREFERRED EMBODIMENTS

Figure 1:
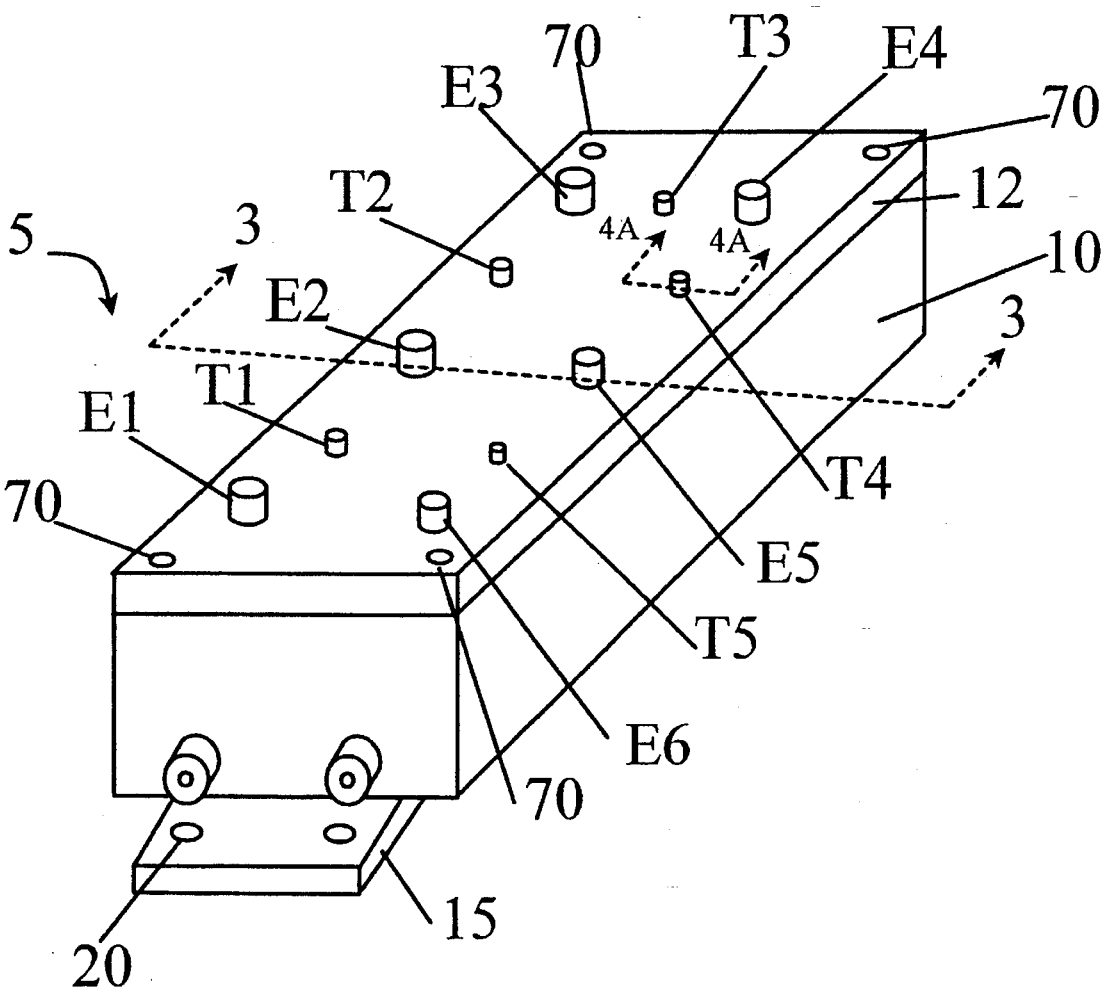
FIG. 1 is a perspective view of the exterior of a filter housing and cover in accordance with the present invention wherein the housing is formed with six cavities obscured by the cover.

With reference to the drawings wherein like reference characters represent like components throughout the various views, and with particular reference to FIG. 1, there is depicted a filter 5 which may be used in, for instance, microwave transmissions, and more particularly for satellite communication applications.

The filter 5 in FIG. 1 includes a unitary housing 10 that is preferably formed from a single block of material, such as aluminum, machined to form the shape depicted. It should be appreciated that other materials may be used, aluminum being one of many materials suitable. The filter also includes a cover 12. At either end of the housing 10 are mounting legs 15 (the second mounting leg is not visible in FIG. 1), each leg 15 having mounting holes 20 for securing the filter to the structure (not shown) within, for instance, a communications satellite.

Figure 2A:
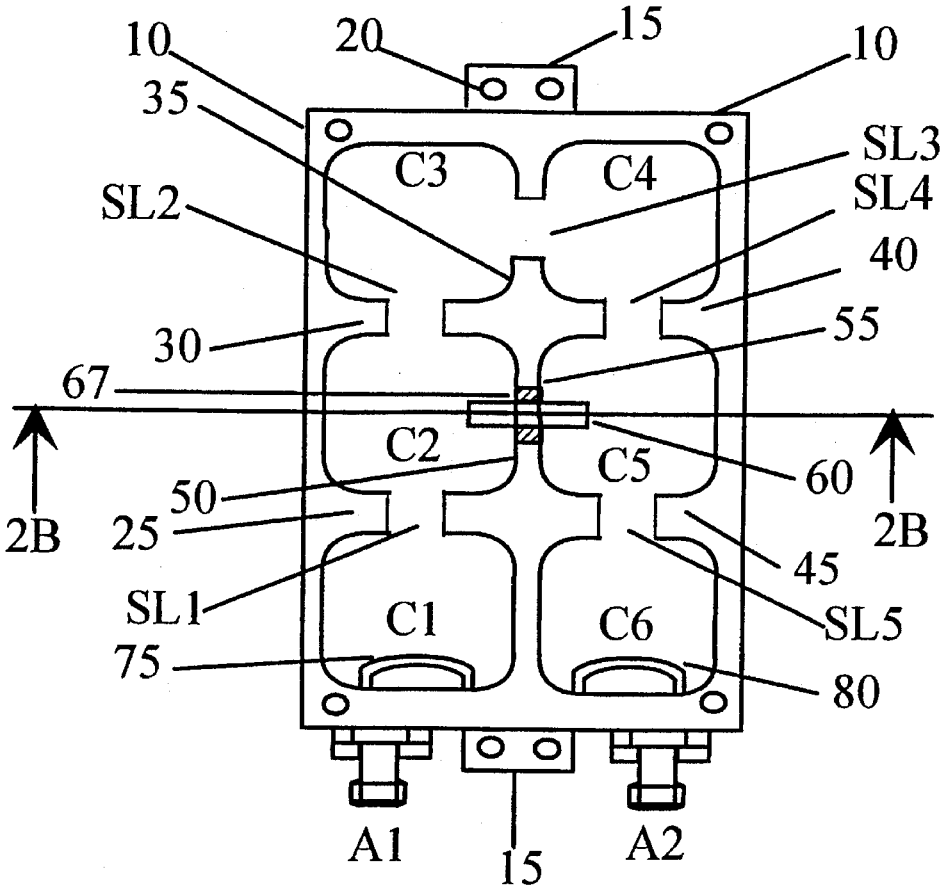
FIG. 2A is a top view of the filter housing depicted in FIG. 1 with the cover removed revealing the six cavities formed therein.

FIG. 2A depicts the filter housing 10 with the cover removed exposing six cavities C1–C6. The housing 10 is formed with slots SL1–SL5, where the slot SL1 is formed in the wall 25 between sequential cavities C1 and C2; the slot SL2 is formed in the wall 30 between the sequential cavities C2 and C3; the slot SL3 is formed in the wall 35 between sequential cavities C3 and C4; the slot SL4 is formed in the wall 40 between sequential cavities C4 and C5; and the slot SL5 is formed in the wall 45 between cavities C5 and C6.

Figure 2B:
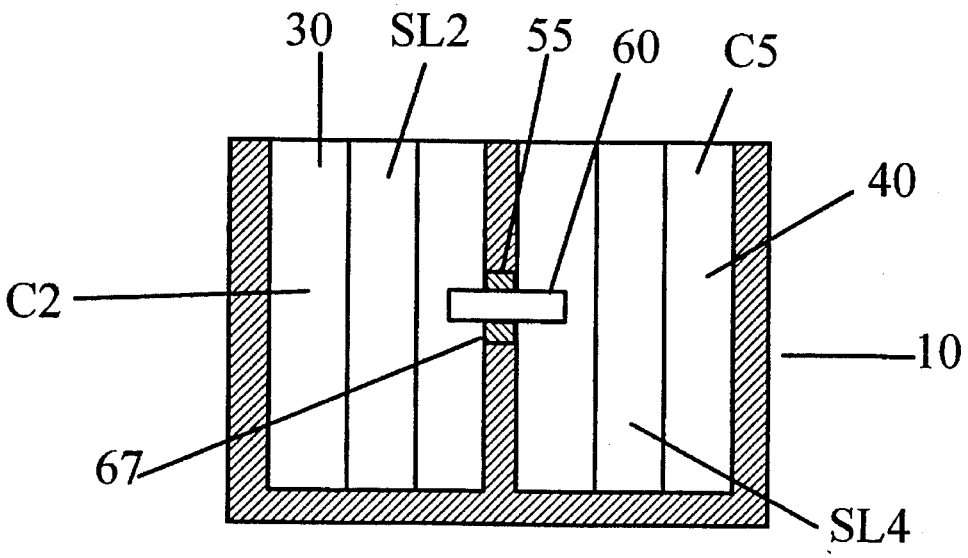
FIG. 2B is a section of the filter housing taken along the line 2B—2B in FIG. 2A, looking in the direction of the arrows.

The wall 50, between non-sequential adjacent cavities C2 and C5 is provided with an aperture 55 into which is positioned a probe 60 surrounded by an insulating material 67 (FIG. 2B). The probes are preferably wires made of beryllium copper, however, several other electrically conductive materials will suffice. The insulating material 67 may be made of any non-conductive material, however, in the preferred embodiment, the insulating material used is Teflon, Rexolite or a ceramic material such as boron nitride. The probe 60 (see FIG. 2B) couples the cavities C2 and C5 in a manner which will be explained in greater detail below.

Figure 2C:
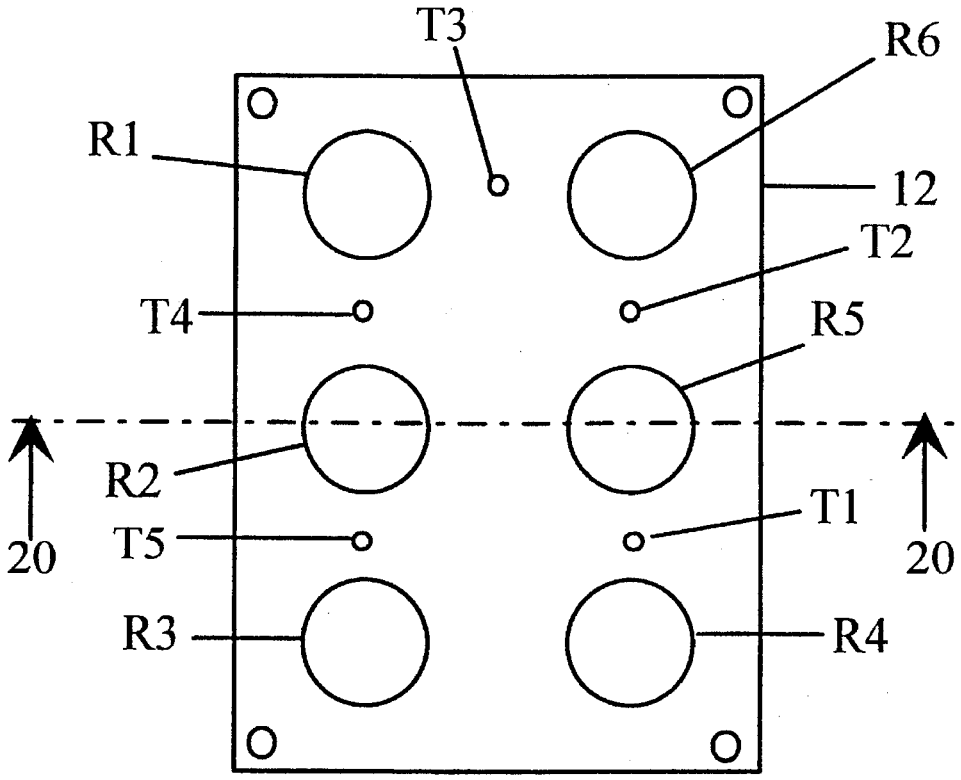
FIG. 2C is a plan view of the undersurface of the cover of the filter depicted in FIG. 1 shown removed from the filter housing.
Figure 2D:
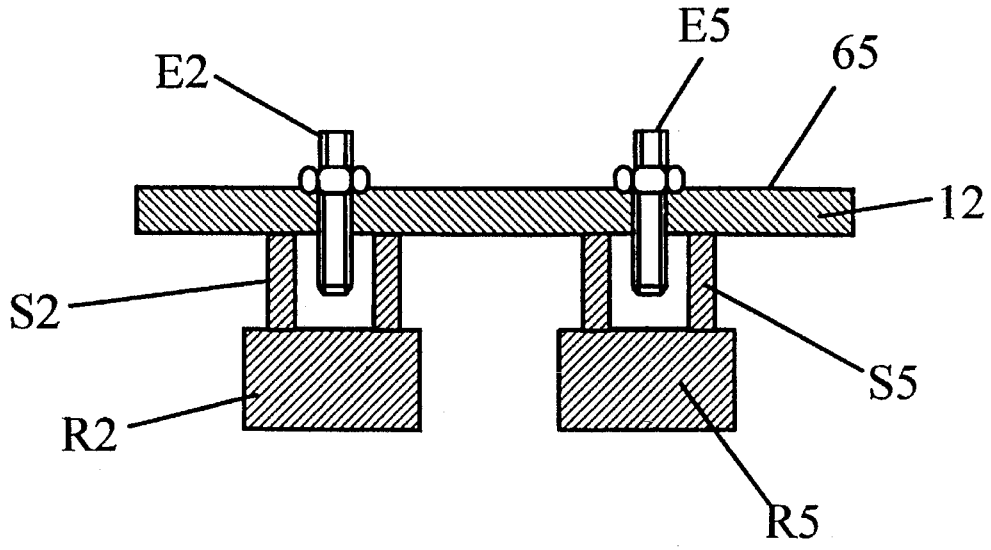
FIG. 2D is a section of the filter cover taken along the line 2D—2D in FIG. 2C, looking in the direction of the arrows.

Referring now to FIGS. 2C and 2D, the cover 12 is depicted. Attached to the underside 65 of the cover 12 are six dielectric resonators R1–R6, respectively, mounted on tubular dielectric supports S1–S6 (only supports S2 and S5 are visible in FIG. 2D). The supports S1–S6 and resonators R1–R6 are positioned on the cover 12 such that when the cover 12 is in place on the housing 10, the dielectric resonators R1–R6 are located close to the center of the cavities C1–C6, respectively, as is more clearly shown in FIG. 3.

The resonator R2 is bonded by adhesive to the support S2, and the resonator R5 to the support S5. Each support is in turn bonded to the cover 12. The resonator supports, such as S2 and S5 are made of a dielectric material having a dielectric constant preferably less than 4, such as a ceramic material DS4, manufactured by Transtech, Adamstown, Md. The dielectric constant of the dielectric resonators, such as R2 and R5, is preferably higher than 20. The dielectric resonators are formed of the M-Series material, manufactured by Murata Co., Kyoto, Japan. However, it should be appreciated that the dielectric constant of the supports and the resonators is a variable factor, and the preferred constant will be determined by, among other considerations, the performance characteristics desired from the filter and the materials used.

The supports S1–S6 are generally identical, therefore the description of supports S2 and S5 are applicable to the remaining supports. Further, the resonators R1–R6 are likewise generally identical and therefore the description of the resonators R2 and R5 are applicable to the remaining resonators.

The supports S1–S6 are cylindrical in shape, having a central bore. A tuning screw E2 is threaded into an aperture in the cover 12, and extends from the cover into the bore of the support S2. A tuning screw E5 is likewise threaded into the cover 12 and extends into the bore of the support S5. The upper ends of each tuning screws E1–E6 are visible in FIG. 1. The tuning screws E1–E6 are generally identical and therefore the description of the tuning screws E2 and E5 are applicable to the remaining tuning screws.

The filter housing 10 and cover 12 are held together by a plurality of screws 70, however the cover 12 could also be welded, bonded, clipped or otherwise fastened to the housing 10 by any of a variety of means.

Referring to FIGS. 1 and 2A, two accesses A1 and A2 to the filter are provided by two generally U-shaped probes 75 and 80, which are disposed at respective ends of the filter. For instance, access A1 can serve as an input junction to the filter 5 and the access A2 can serve as an output. In FIG. 2A, the probes 75 and 80 are shown as U-shaped wires. However, it should be understood that other shapes could be used as will be understood more clearly with regard to the description of the coupling probes depicted in FIGS. 5–8 below.

FIG. 4A depicts the slot SL4 formed in the wall 40. A tuning screw T4 rotatably threaded into the cover 12 is used to tune the coupling between the resonators R4 and R5 (not shown in FIG. 4A). Tuning screws T1–T5 are provided in the slots SL1–SL5 respectively. Each tuning screw is generally the same and therefore the description of one is applicable to all of the tuning screws T1–T5.

FIG. 4B depicts an alternate means for tuning slot couplings between resonators and/or cavities in a manner believed to be new and unique. A fin 82 attached to the lower end of a screw 83 is used in place of each of the tuning screws T1–T5, one fin 82 substituted for each tuning screw. Each fin 82 acts in a manner analogous to an air duct baffle, in that the fin 82 blocks portions of the magnetic flux lines that couple two adjacent resonators. The using fin 82 may be made of a number of material such as aluminum or copper.

FIGS. 4C, 4D and 4E depict three positions of the many positions possible for adjusting the fins 82. For instance, when the fin 82 is in the position depicted in FIG. 4C, the coupling between the resonators R4 and R5 is at a maximum. In the position depicted in FIG. 4D, the fin 82 partially inhibits the coupling between the resonators. In the position depicted in FIG. 4E, the fin 82 reduces the coupling between the resonators R4 and R5 to a minimum. It should be understood that one fin 82 may be used in each of the slots SL1–SL5 and that each fin 82 is generally identical. Therefore, the description above is applicable to each fin 82 when substituted for the tuning screws T1–T5. Further, there may be filter applications where several slots may be provided with a tuning screw and other slots are provided with tuning fins. Such combinations of tuning screws and tuning fins are within the contemplated scope of the present invention. It should be appreciated that tuning fins 82 may also be employed in waveguide cavities without the presence of a dielectric resonator.

With reference again to FIG. 2A, the orientation of the two rows of cavities, the first row being cavities C1–C3, and the second row being C4–C6, is referred to hereafter as a folded configuration. One of the purposes of folding the resonator cavities C1–C6 into two rows is to provide common walls between non-sequential cavities, into which cross couplings, which provide special features to the filter's bandwidth output characteristics, may be inserted. The special features with respect to the output of the filter will be discussed further below.

Figure 3:
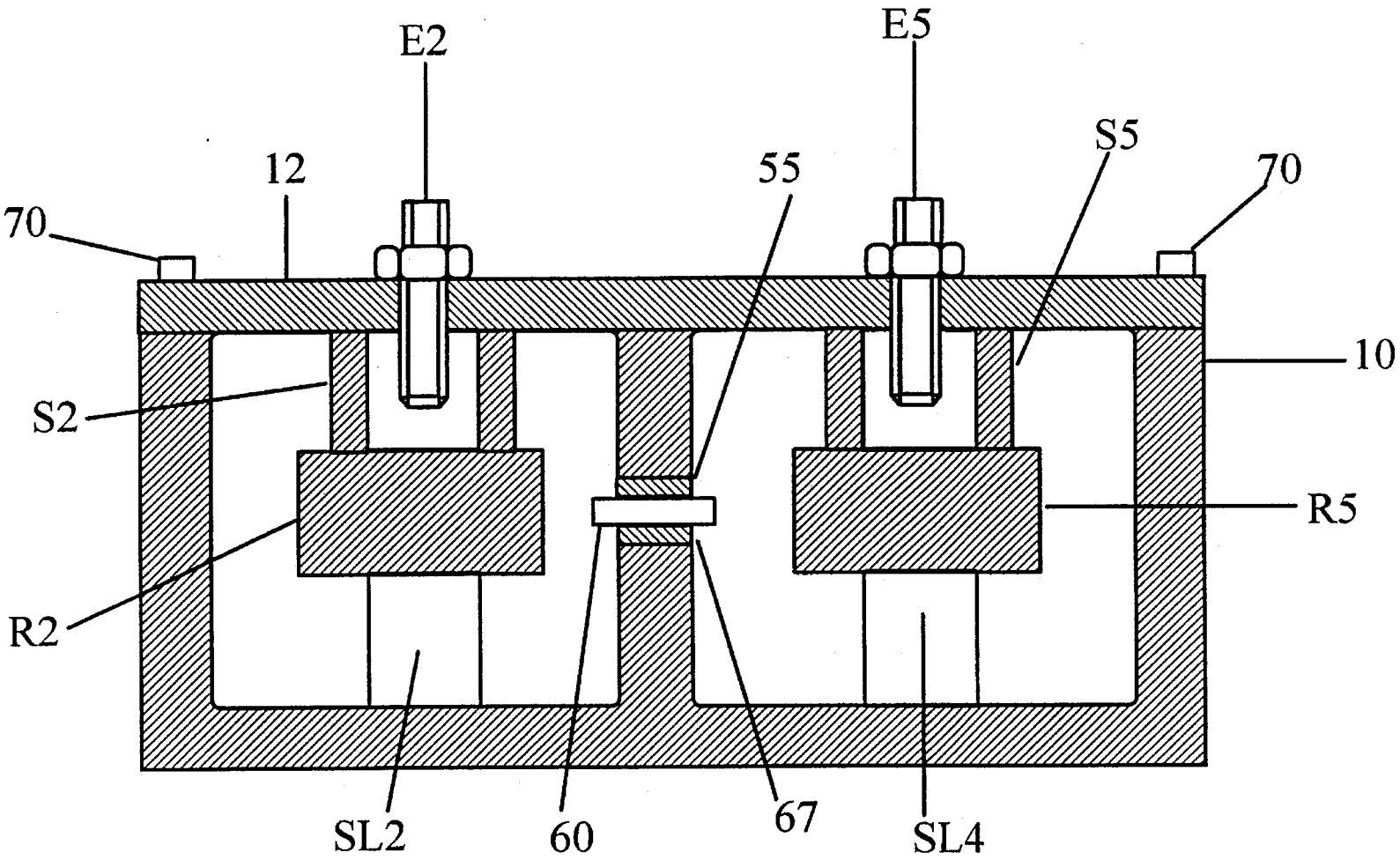
FIG. 3 is a section of the filter taken along the line 3—3 in FIG. 1 looking in the direction of the arrows, on an enlarged scale, showing two dielectric resonators disposed within their respective cavities, and a probe coupling the two resonators.
Figure 5:
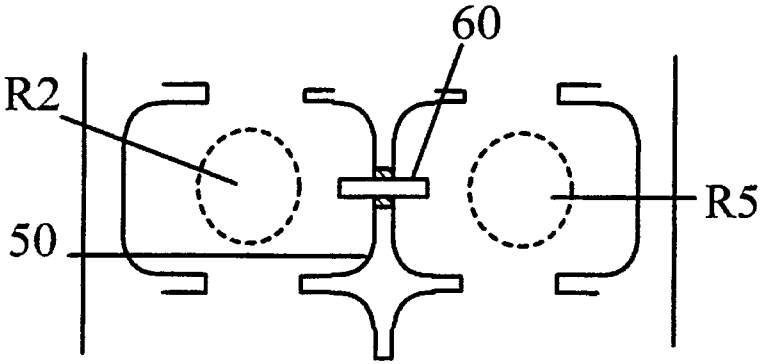
FIGS. 5, 6A, 6B, 7A, 7B and 8 are partial top views of the filter housing depicted in FIG. 2A showing various probe configurations which provide cross-coupling between two adjacent, non-sequential cavities.

The probe 60 in FIGS. 2A and 5 provides cross coupling within the filter 5 between non-sequential adjacent resonators R2 and R5, FIG. 3. The coupling between cavities, in a theoretical or mathematical sense, is given a sign, either positive or negative. The sequential couplings provided between resonators via slots SL1–SL5 are chosen in a mathematical sense to be positive couplings. The sign of the probe coupling (positive or negative relative to the positive coupling of the slots SL1–SL5) can, according to the teachings of the present invention, be selectively determined. The probe 60 is shown in greater detail in FIG. 5, in a partial view of the filter 5. The probe 60 as depicted in FIG. 5, provides limited negative coupling between these two resonators by means of the electric field lines, i.e. they convey a portion of the energy of resonator R2 in phase opposition to the vicinity of resonator R5. The negative coupling makes it possible to move the transmission zero on either side of the amplitude-frequency response curve of the filter, as will be explained in greater detail below. However, the probe configuration depicted in FIG. 5 provides resonator coupling that is limited and therefore may not be advantageous in some filter designs. Further, the probe 60 does not provide a means for changing the sign (positive or negative) of the coupling.

Alternate embodiments of the probe 60 are described with reference to FIGS. 6A, 6B, 7A, 7B and 8. The probe 61 in FIG. 6A is S-shaped, having a body portion 56 with extending legs 85, the legs 85 being asymmetrical with respect to the wall 50. The probe 61 provides coupling of the resonant energy of the resonators R2 and R5, and the asymmetrical extension of the legs 85 produces a positive coupling. An alternate embodiment of a probe 61' (FIG. 6B) includes a body portion 57 where the legs 85' have a curved contour corresponding to the curvature of the resonators R2 and R5, which increases the efficiency of the coupling. The curved contour of the legs 85' conforms to an arc which may share a common center point with the dielectric resonators R2 and R5.

Figure 7B:
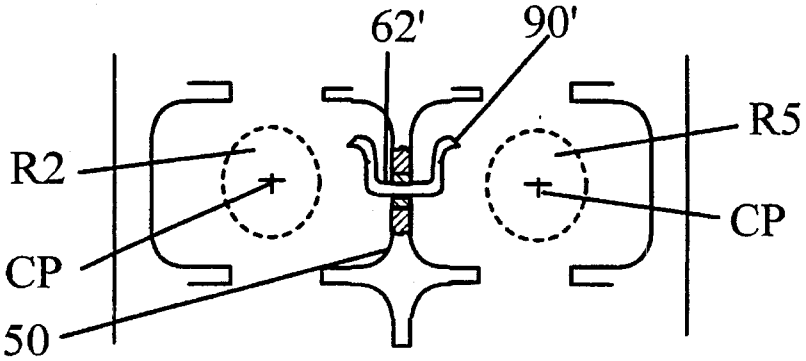
Figure 7A:
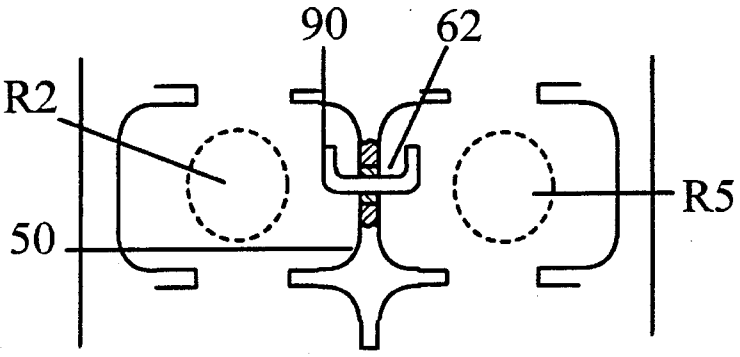

In the embodiment depicted in FIG. 7A, a probe 62 has U-shaped legs 90 which are symmetrical about the wall 50. The probe 62 provides coupling between resonators R2 and R5 which is negative. In FIG. 7B, the probe legs 90' are formed with a curved contour corresponding generally to the curvature of the resonators R2 and R5.

Figure 8:
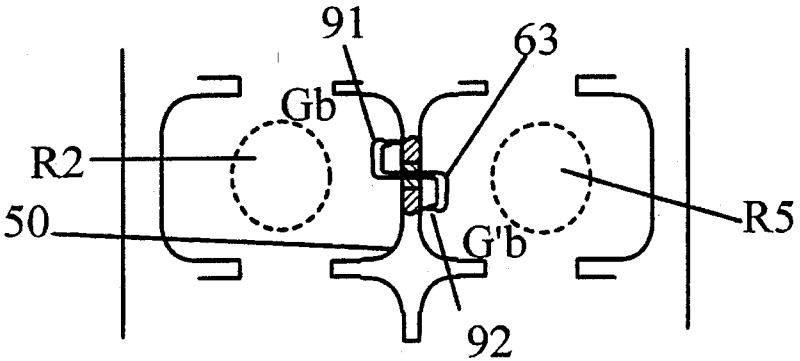

In FIG. 8, a probe 63 includes two loops 91 and 92 made by means of a conductive wire which is folded in the vicinity of its ends so as to form the two generally U-shaped loops, in a horizontal plane on opposite sides of the wall 50, so as to bring the opposite ends of the probe 63 into contact with the common wall 50. The probe 63 in FIG. 8 provides negative coupling due to the opposite directions which the loops take on opposite sides of the common wall in combination with being in contact with the wall 50. Magnetic flux lines from the resonator R2 pass through the portion of the coupling loop 91 adjacent the resonator R2, induce a current in the probe 63 which passes through the cavity wall 50 to the loop 92 in the resonator cavity C5. In resonator cavity C5 the direction of the current in the probe wire 92 tends to produce a magnetic flux the direction of which will be in opposition to the direction of the magnetic flux of the resonator R5 within that cavity C5, thereby producing a negative-value coupling.

As was discussed above, the two accesses A1 and A2, FIG. 2A, are provided with probes 75 and 80. The probes 75 and 80 may be replaced with other probe shaped like any of the probe legs 85, 85', 90 or 90', FIGS. 6A, 6B, 7A, and 7B respectively, as dictated by the desired output of the filter.

Figure 9:
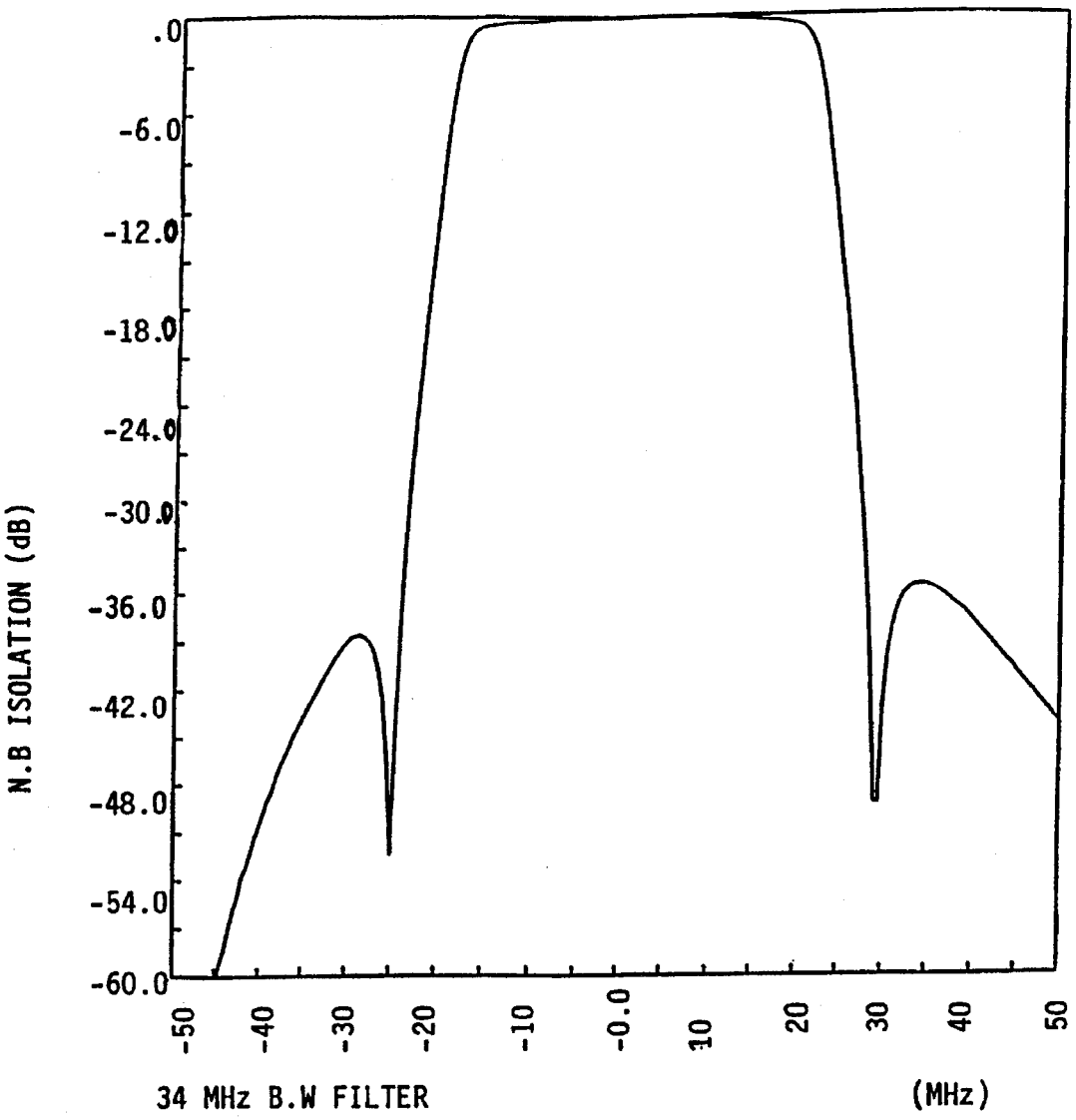
FIG. 9 is a graph depicting the measured bandwidth output obtained from the filter shown in FIG. 1.

FIG. 9 is a graph depicting the frequency bandwidth output of the filter shown in FIGS. 1 through 3. The significance of portions of the output curve will be discussed further below.

Figure 10A:
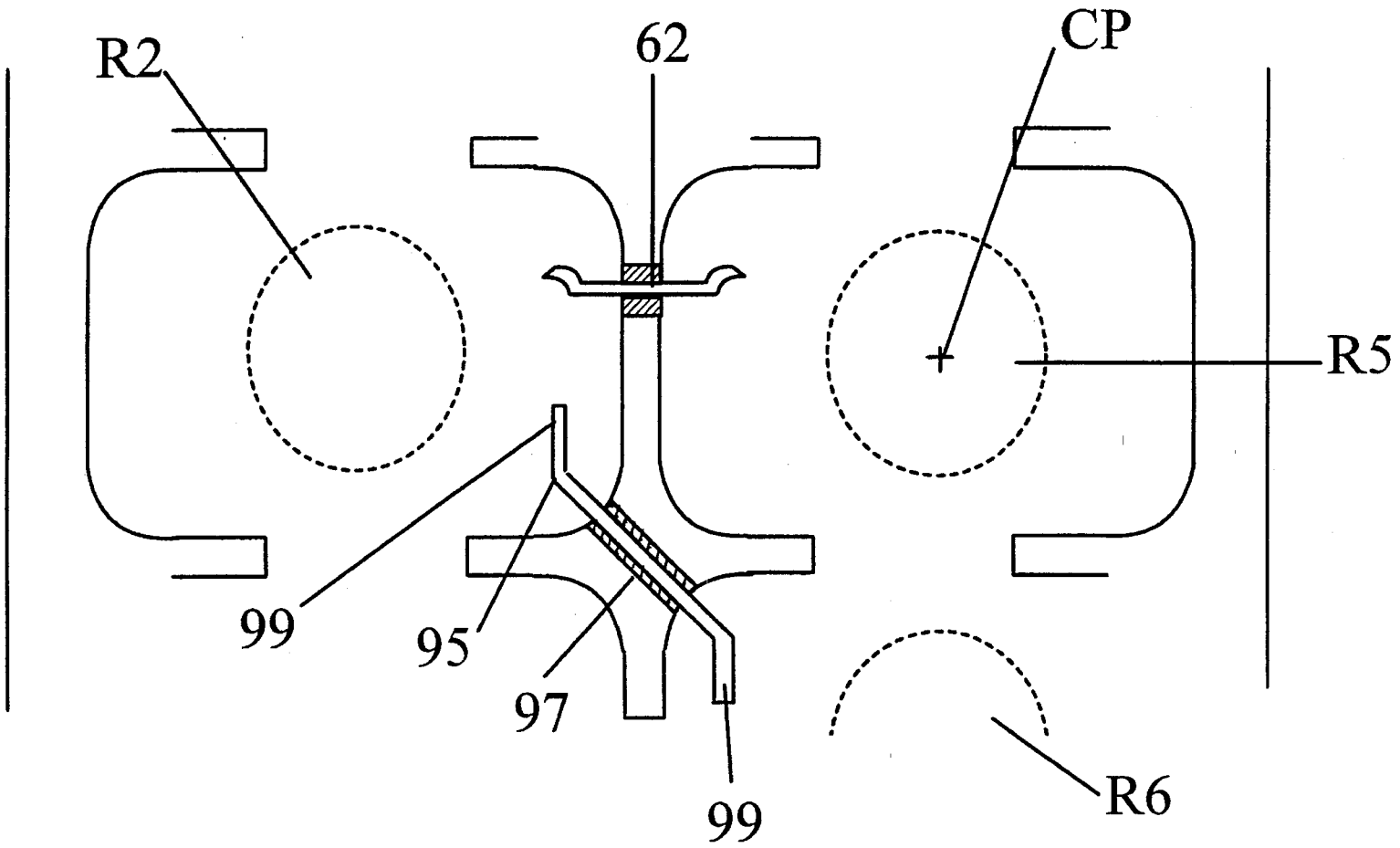
FIGS. 10A, 10B and 10C are partial top views of the filter shown in FIGS. 5–8 depicting a single optional diagonal cross coupling probe which couples non-adjacent, non-sequential resonators and cavities as well as a probe coupling two adjacent resonators and cavities.

FIG. 10A depicts a probe 95 which may optionally be employed in the filter 5 to diagonally couple resonators R2 and R6, or other contiguous, non-adjacent pairs of resonators (such as R1 and R5, R3 and R5 or R2 and R4). The filter housing 10 is provided with an opening 97. The opening 97 is fitted with an insulating material 98. The insulating material 98 isolates the probe 95 from the housing 10. The probe 95 has legs 99 which are asymmetrical about the opening 97.

Figure 10B:
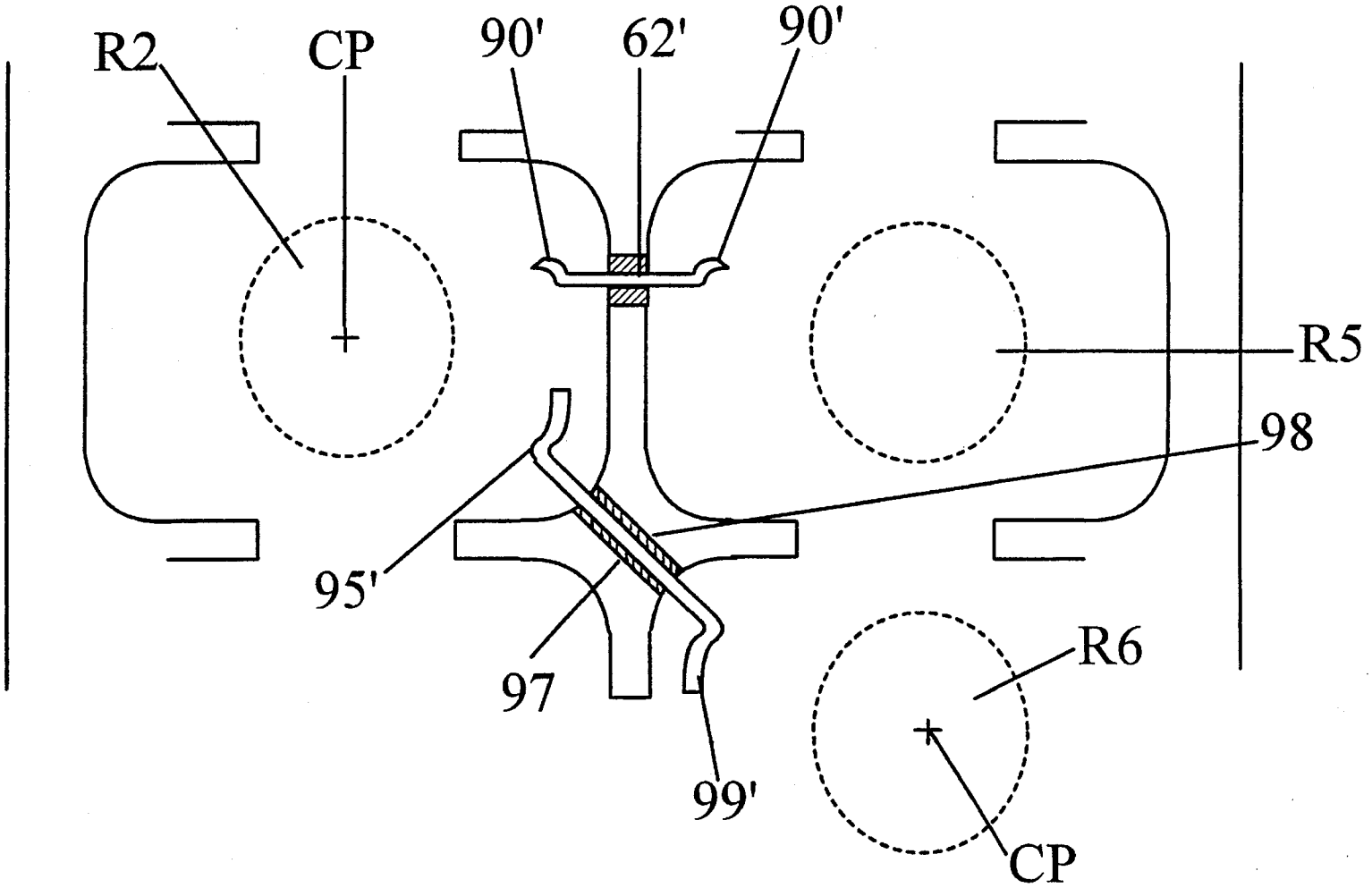

In an alternate embodiment depicted in FIG. 10B, the probe 95' has legs 99' which have a curved contour generally corresponding to the curvature of the resonators R2 and R4. The curved contour of the legs 99' is such that the legs are each spaced at a uniform distance from the curved surfaces of the resonators R2 and R4, respectively, or put another way, the radius of curvature of the legs 99' shares a common center point CP with that of the adjacent resonator. The probe configurations depicted in FIGS. 10A and 10B provide positive coupling between resonators.

Figure 10C:
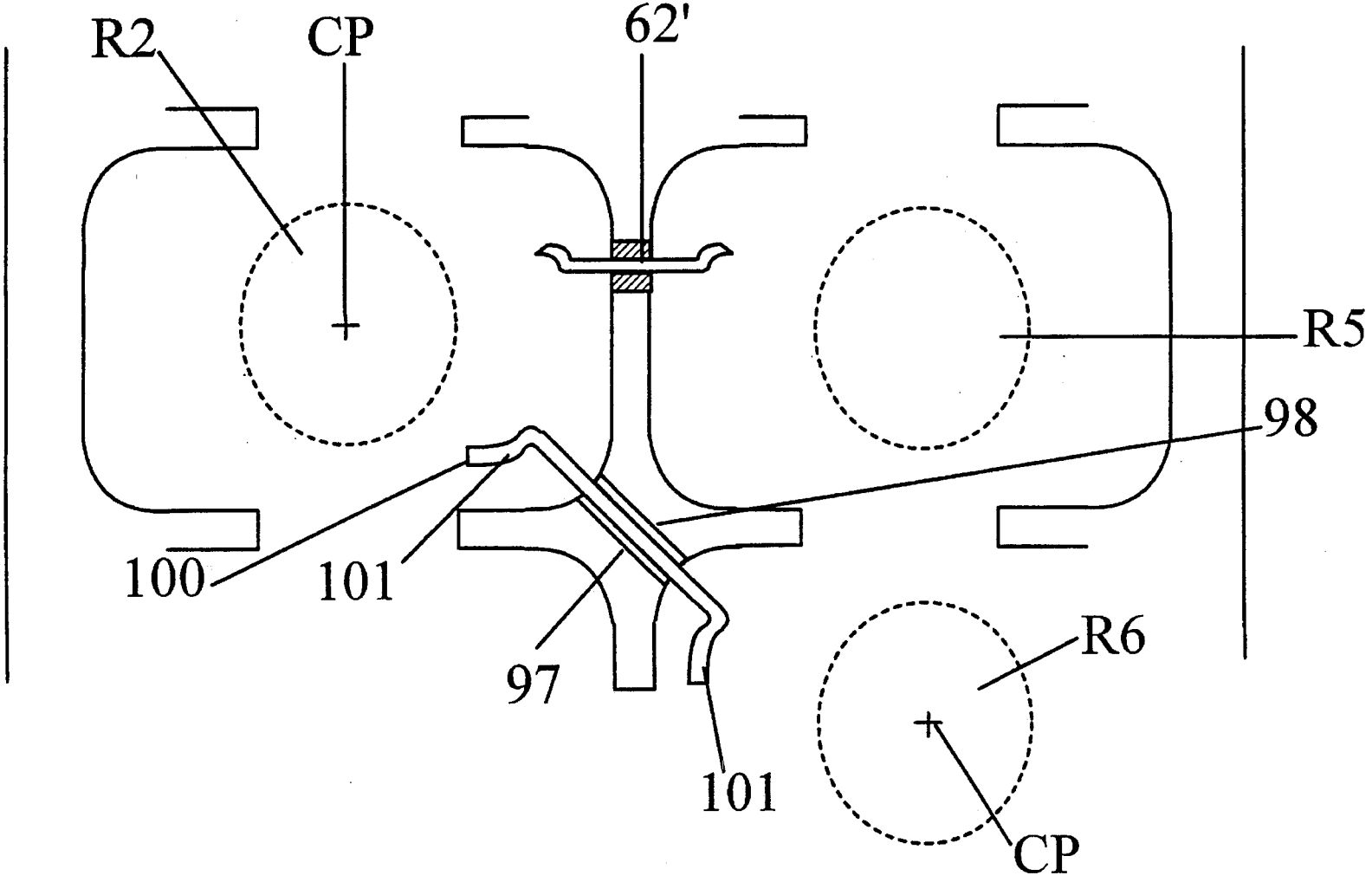

The sign of the cross diagonal coupling described with respect to the probes depicted in FIGS. 10A and 10B can be selectively determined. For instance, a probe 100 depicted in FIG. 10C provides negative coupling between the resonators R2 and R6, as will be explained further below. The probe 100 is provided with legs 101 which have a curved contour generally spaced to be at a uniform distance from the surface of the adjacent cylindrically shaped resonator.

The present invention is not limited to a six cavity and six resonator configuration. The number of cavities and resonators in a microwave filter is a function of the desired output requirements of the filter. For instance, an eight cavity/resonator filter and a ten cavity/resonator and larger numbers of cavity/resonator filters are contemplated using the coupling means described above. A six cavity/resonator filter is referred hereinafter as a sixth degree filter, an eight cavity/resonator filter as an eighth degree filter, and so on.

Figure 11:
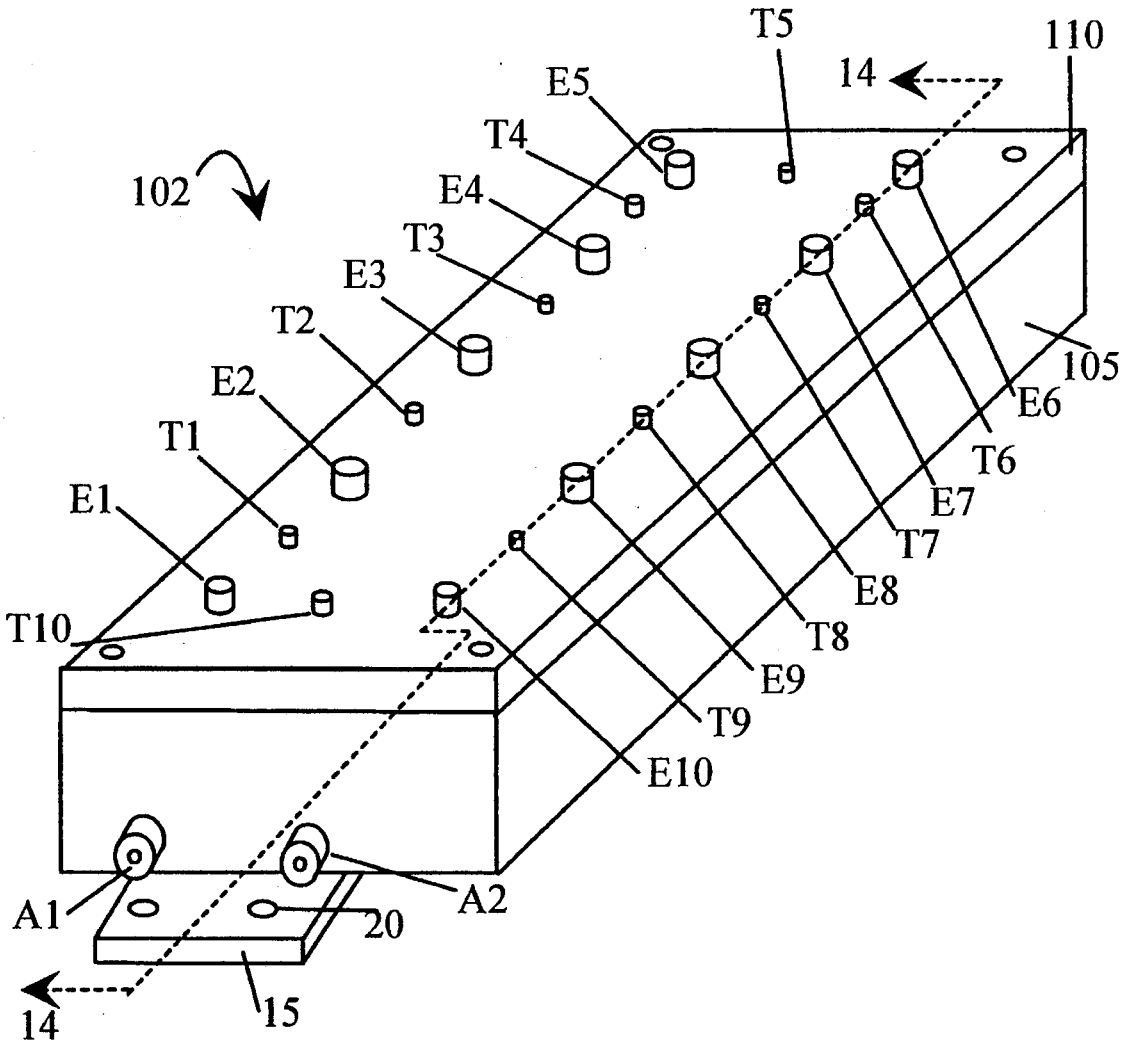
FIG. 11 is a perspective view of the exterior of an alternate embodiment of the filter, showing the filter housing and cover, wherein the housing is formed with 10 cavities obscured by the cover.
Figure 12:
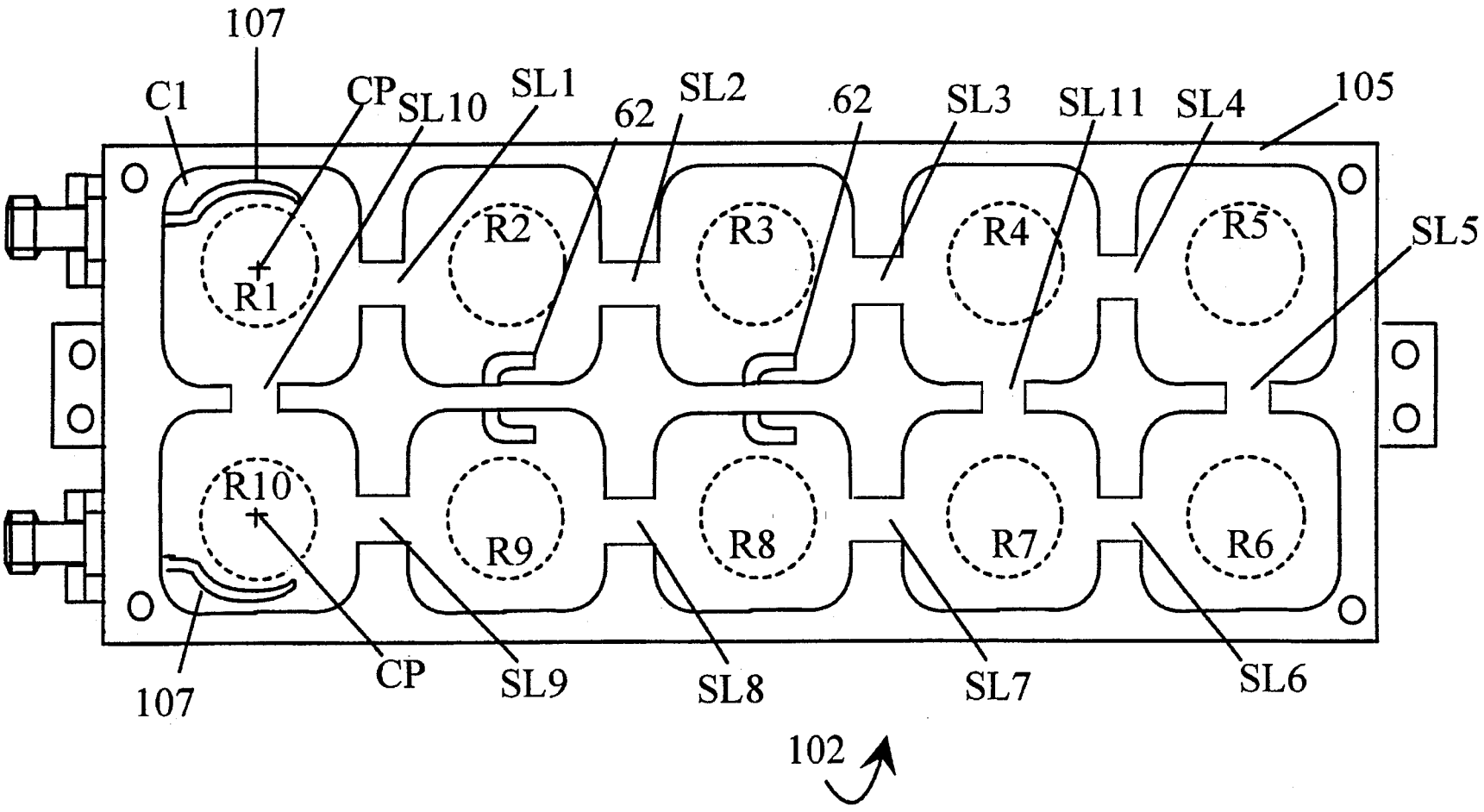
FIG. 12 is a top view of the filter housing depicted in FIG. 11 with the cover removed revealing ten cavities formed therein.

FIG. 11 depicts a tenth degree filter 102 having ten cavities. The filter 102 has a housing 105 and a cover 110. The housing 105 is depicted in FIG. 12 with the cover 110 removed, exposing the cavities C1–C10 and showing ten dielectric resonators R1–R10 in phantom. The cavities C1–C10 are coupled to sequential adjacent cavities via a slot, such as the slots SL1–SL9, in a manner similar to the coupling described with respect to the embodiment depicted in FIGS. 1–3. Additional slots SL10 and SL11 are provided for positive cross coupling of non-sequential, adjacent cavities C1 and C10, and cavities C4 and C7, respectively.

Figure 13:
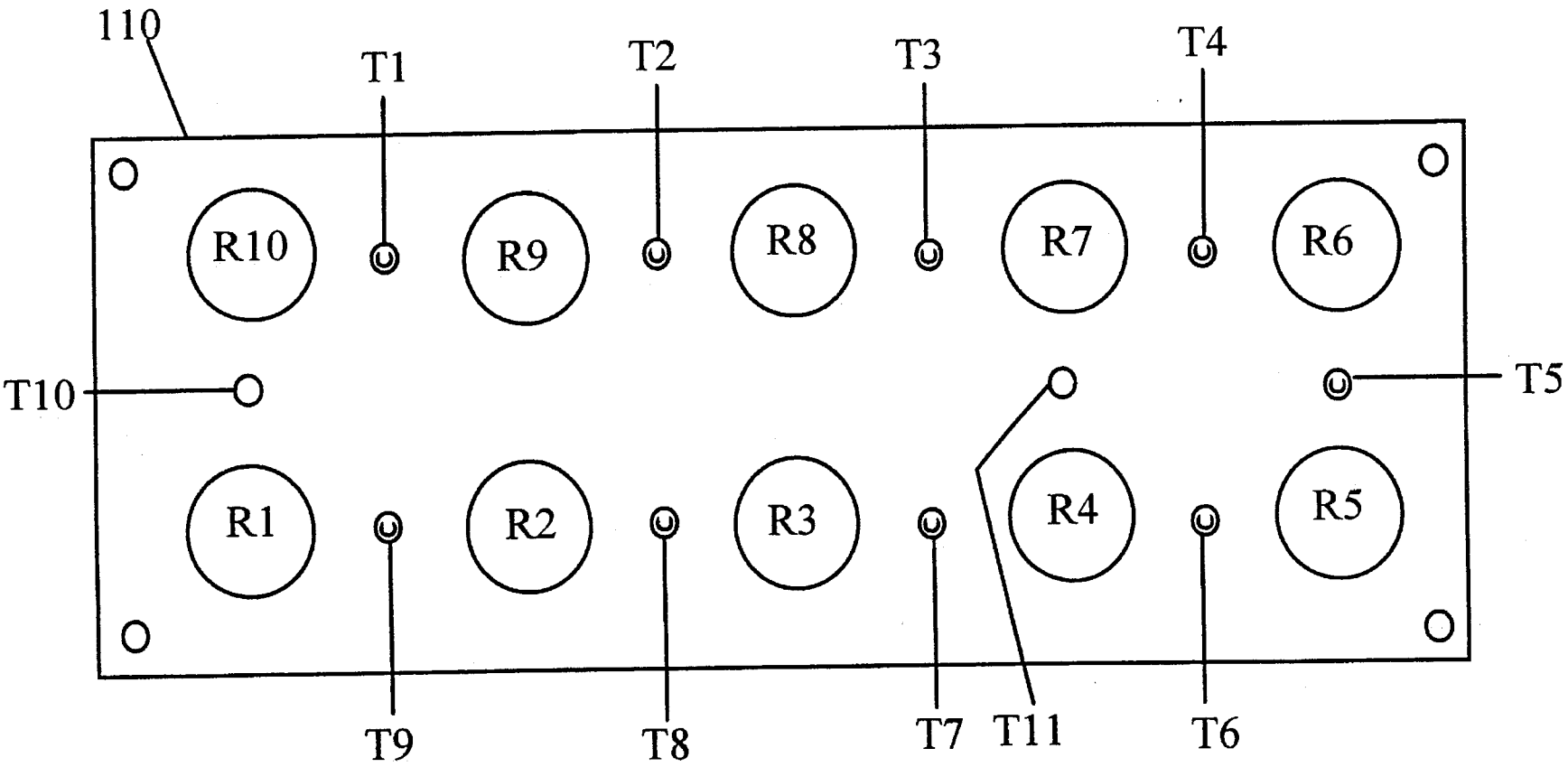
FIG. 13 is a view of the undersurface of the cover of the filter shown in FIG. 11 shown removed from the filter housing, depicting ten dielectric resonators.

FIG. 13 shows the underside of the cover 110 with the resonators R1–R10 attached thereto via dielectric supports (not visible in FIG. 13).

Figure 14:
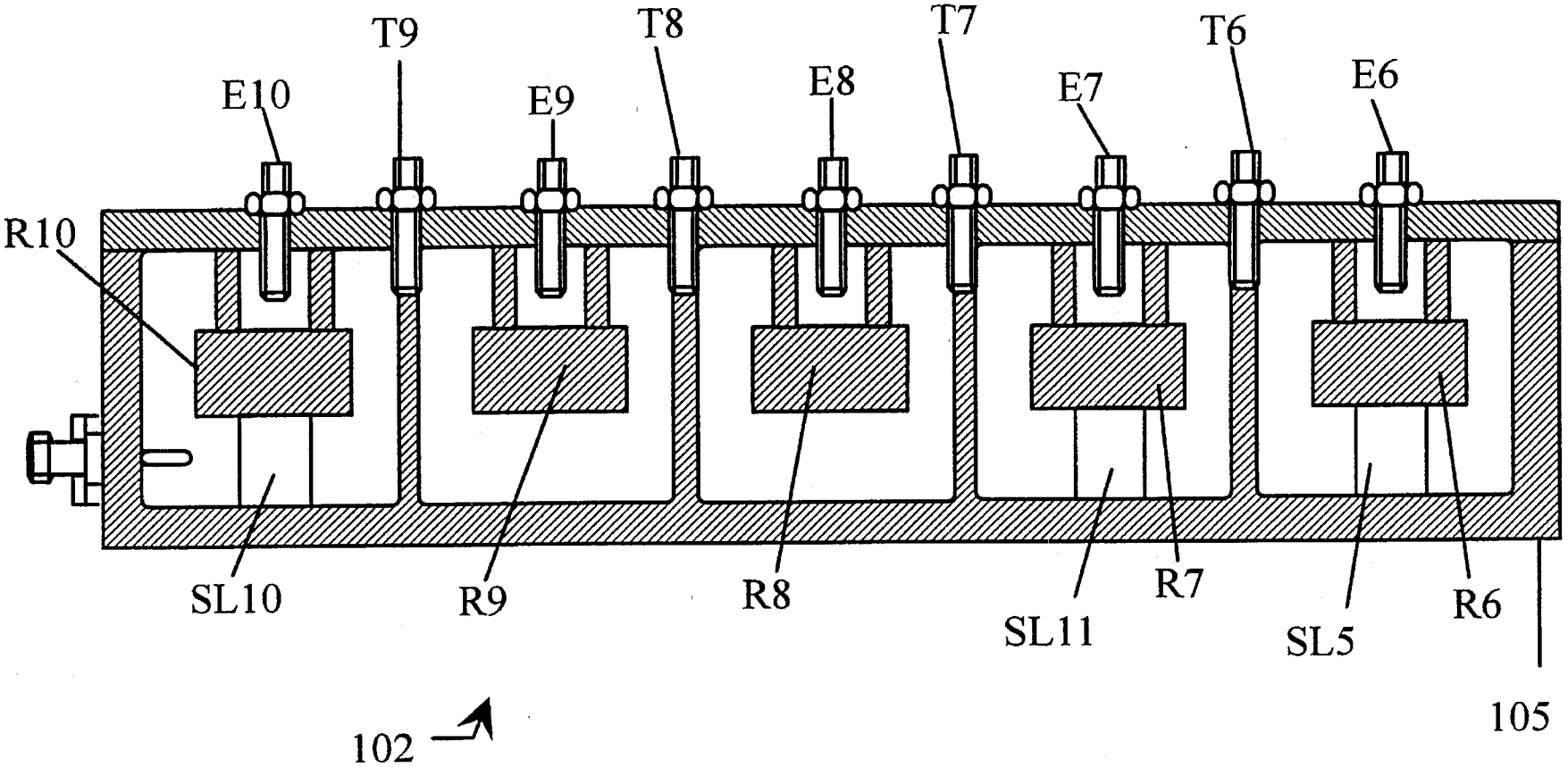
FIG. 14 is a section of the filter taken along the lines 14—14 in FIG. 11, looking in the direction of the arrows, on a slightly enlarged scale, showing the dielectric resonators disposed within the cavities, the resonator supports and tuning screws.

FIG. 14 depicts, in a sectional view, the assembled filter 102 with the resonators disposed within the cavities C1–C10 respectively.

The filter depicted in FIGS. 11–14 is a tenth degree filter comprising two folded rows of five dielectric loaded resonator cavities. The filter 102 further includes two accesses A1 and A2 at the ends of the filter housing 105 with each access constituted by a connection which is terminated in the first and last cavities of the series of cavities. Each of the accesses A1 and A2 is provided with a probe 107. Each probe 107 has a curved contour that is generally uniformly spaced from the curved surface of the adjacent resonator, such that the resonator and the probe share a common center point CP. With reference to FIGS. 13 and 14, it should be appreciated that the resonator tuning screws E1–E10, the supports S1–S10, and the slot tuning screws T1–T9 are generally of the same construction as the resonator tuning screws, slot tuning screws and supports described with respect to the filter 5 in FIGS. 1–3 above. Further, the slot tuning screws T1–T9 in the filter 102 could be replaced by the tuning fins 82 described with respect to FIGS. 4B–4E.

The filter 102 is further provided with cross coupling probes 62 which couple cavities C3 and C8, and cavities C2 and C9, respectively. However, it should be appreciated that the filter 102 could be provided with any of the probes depicted in FIGS. 5–8 and 10A and 10B. The types of probes used would be determined by the desired output of the filter.

Figure 15:
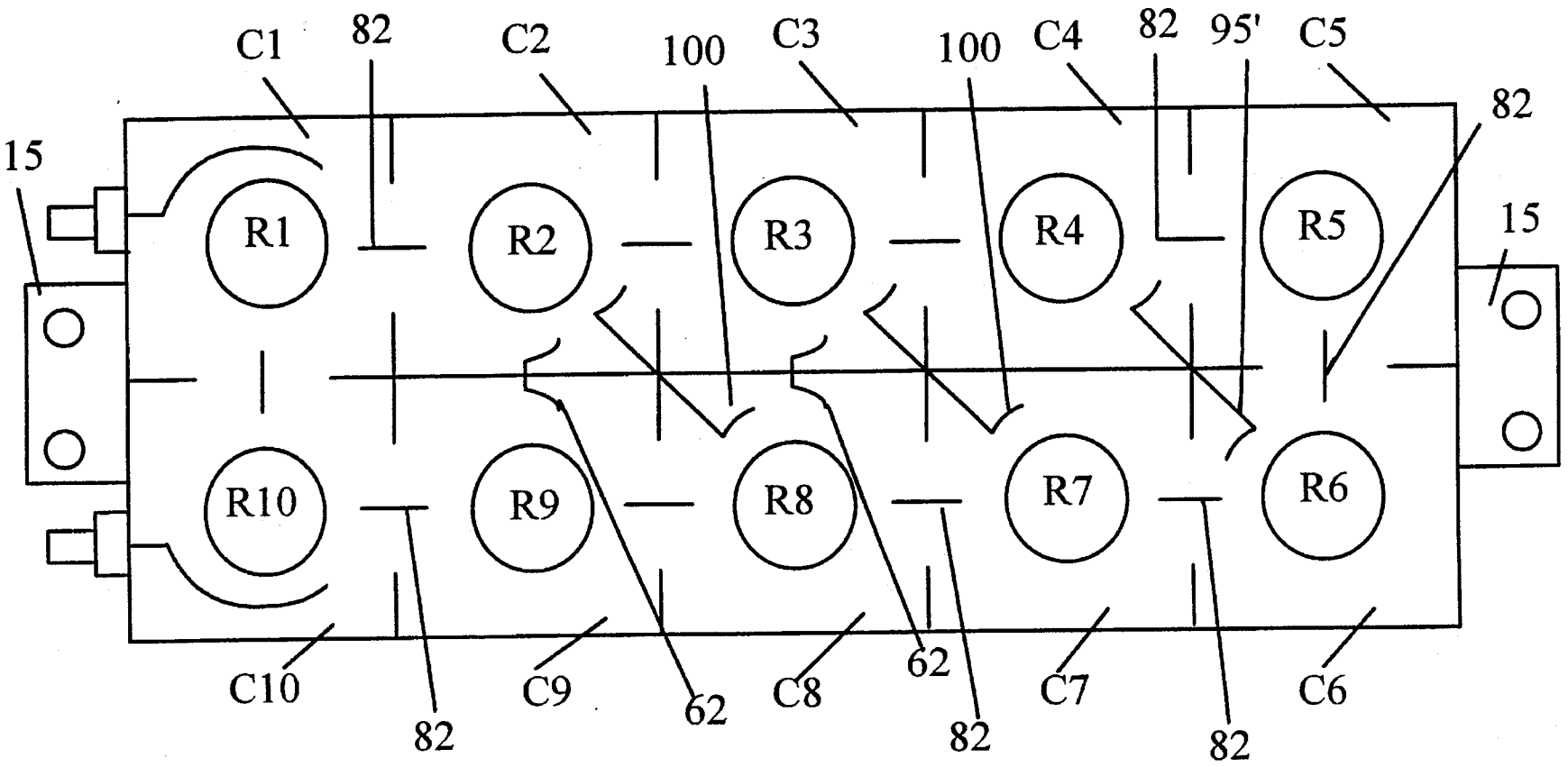
FIG. 15 is a schematic of another embodiment of the present invention with the cover removed wherein each of the ten cavities has a dielectric resonator disposed therein, each cavity is coupled to adjacent sequential cavities by a slot formed in the common wall therebetween, at least two adjacent non-sequential resonators and cavities are coupled by a probe, and at least two non-adjacent, non-sequential cavities are coupled by a probe.

For example, an alternate embodiment of the tenth degree filter of the present invention is depicted schematically in FIG. 15 wherein ten cavities C1–C10 have resonators R1–R10 disposed therein. The housing 125 is formed with slots SL1 through SL9, one slot in the wall formed between each adjacent sequential cavities. Each slot is provided with a slot coupling adjusting fin 82. The slots provide coupling between each pair of adjacent, sequential resonators. For instance, the slot SL1 couples resonators R1 and R2, slot SL2 couples resonators R2 and R3, and so on . . . Resonators R2 and R9 are cross coupled by the probe 62' having legs 90'. Resonators R3 and R8 are also cross coupled by a probe 62' having legs 90'.

Non-adjacent, non-sequential resonators R2 and R8 are cross diagonally coupled by the probe 100. Non-adjacent, non-sequential resonators R3 and R7 are cross diagonally coupled by the probe 100. Both of these couplings are negative, relative to the positive slot coupling.

Non-adjacent, non-sequential resonators R4 and R6 are cross diagonally coupled by the probe 95', providing a positive coupling. Further, cavities C1 and C10 are coupled by a slot SL10.

It should be appreciated that variations of the couplings provided in the filter depicted in FIG. 15 are contemplated. For instance, in some filter applications, only one cross diagonal coupling may be required, preferably between resonators R4 and R6. In other applications, two cross diagonal couplings may be desirable. In this case, cross diagonal couplings between resonators R2 and R8, and R4 and R6 may be preferable.

Figure 16:
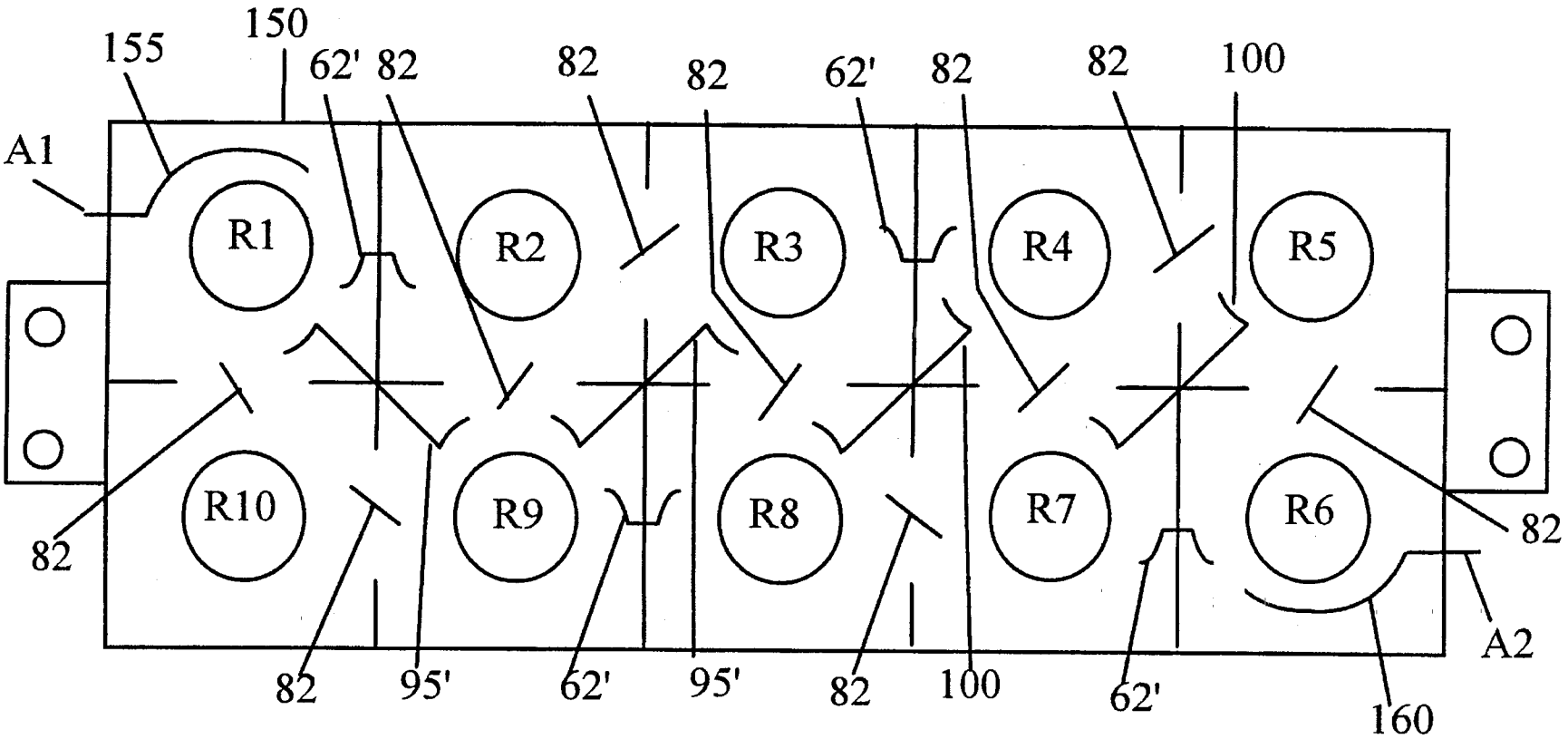
FIG. 16 is a top view of another alternate embodiment of the present invention wherein each cavity has a dielectric resonator disposed therein, each resonator and corresponding cavity is coupled to sequentially adjacent cavities by a slot formed in common walls and coupled to non-sequential adjacent cavities by probes disposed in common walls.

FIG. 16 depicts yet another embodiment of the present invention, wherein a housing 150 is provided with an input A1 having a probe 155 and an output A2 having a probe 160. Ten cavities C1 through C10 are folded in pairs of cavities, such that there are five rows of cavities, C1 and C2 being the first row, C3 and C4 being the second row, and so on. In the embodiment depicted in FIG. 16, slots SL1 through SL9 are formed in the housing 150 walls, such that slot SL1 couples cavities C1 and C2, slot SL2 couples cavities C2 and C3 and so on. One resonator is disposed in each cavity, resonators R1–R10 disposed in cavities C1–C10, respectively. Each slot I1 through SL9 is provided with a slot adjusting fin 82. Further, several non-sequential adjacent cavity resonators are coupled by probes 62', such as resonators R1 and R4, R3 and R6, R5 and R8, and R7 and R10. There are also several cross-diagonal couplings included in the filter housing 150. For instance, the first probe 95' couples cavities C1 and C3, a second probe 95' couples cavities C3 and C5, a first probe 100 couples cavities C6 and C8, and a second probe 100 couples cavities C7 and C9. It should be understood that various combinations of cross couplings and cross diagonal couplings are possible in the filter 150. Not all of the couplings depicted in FIG. 16 are necessary in each filter application. For instance, one application may require only one cross diagonal coupling in order to provide the desired filter output, and in another application, two or more may be required to provide the necessary output. In other embodiments, some of the cross couplings provided by the probes 62' may be substituted with additional slots or other probe configurations and probe shapes as discussed above with respect to FIGS. 5–8.

The design process for microwave filters, such as the various embodiments of filters described herein, typically involves the representation of the filter using polynomial equations in order to predict the output of the filter. Some of the characteristics of the filter may be predicted, such as the filter's transfer characteristics (group delay equalization, or transmission zeros, or a combination of both), are built into the polynomials which, under analysis, yield an idealized prediction of the performance that the realized filter will hopefully yield. Such mathematical modeling of filters, in general, is well known. An example of such theoretical, mathematical modeling using polynomials may be found in, for instance, the publication entitled "General Prototype Network-Synthesis Methods For Microwave Filters" by R. J. Cameron, published in the ESA Journal 1982, Volume 6, pages 193–206, which is incorporated herein by reference.

During the development of the embodiments of the filter of the present invention, the theoretical, mathematical analysis indicated that predicted output of the several embodiments of filter were desirable if cross couplings (couplings between non-sequential resonators) were available. The probes 60–62 provide the cross-coupling between non-sequential adjacent resonators.

The resonator/cavity couplings provided by the slots are magnetic field-to-magnetic field couplings and are considered to be positive, in a theoretical, mathematical sense. Typically, if one coupling is electric where all the others are magnetic then the electric field coupling will be negative (in a mathematical sense) with respect to the positive magnetic coupling. Real-axis zeros were found to be desirable in the analysis of the filter to produce what is known in the art as group delay equalization. Transmission zeros appear in the filter characteristic or output of the filter as a result of combining positive and negative couplings in a single filter. The presence of transmission zeros assists in providing a more desirable filter output.

In some filter applications combinations of negative and positive couplings are desirable, and in other applications, all positive or all negative couplings may be desirable.

Figure 17:
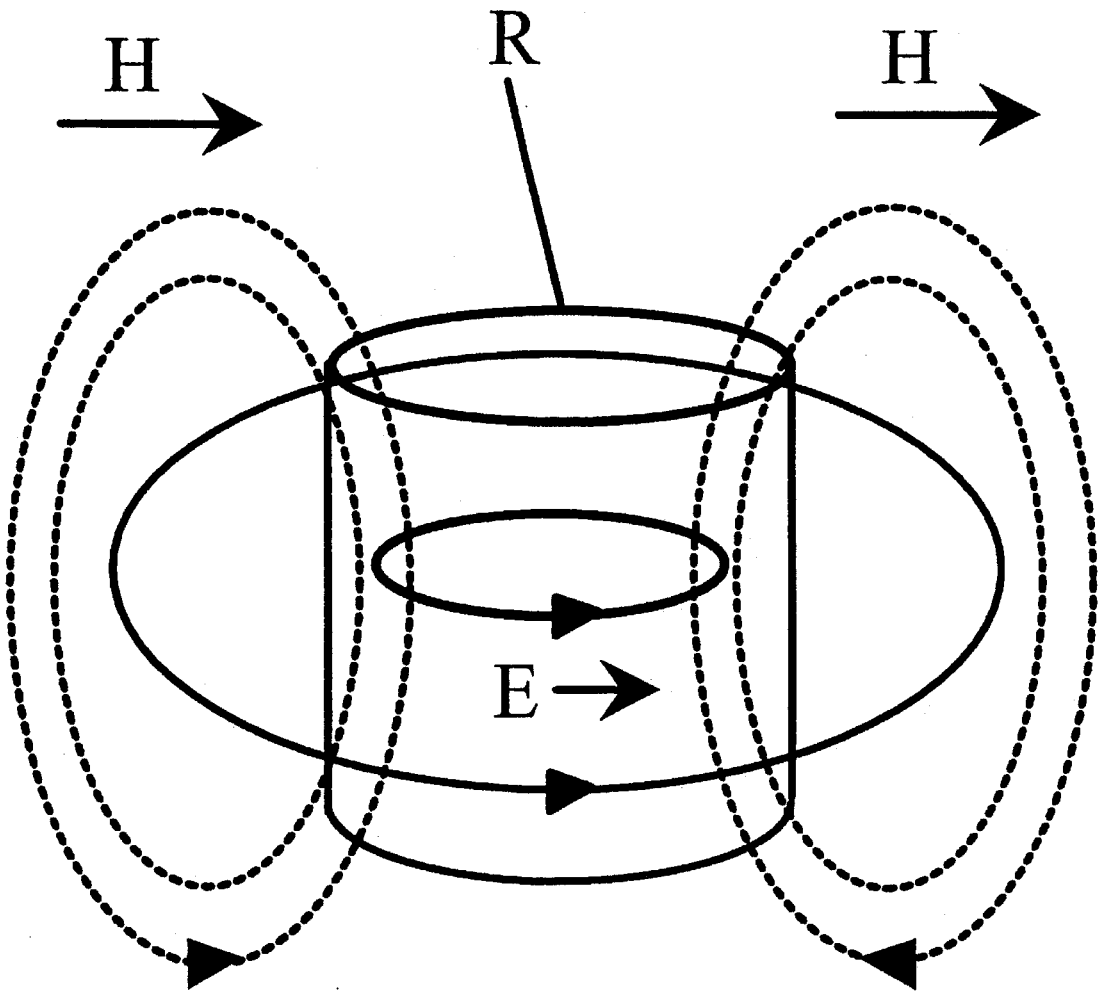
FIG. 17 is a perspective diagram depicting a dielectric resonator and the electro-magnetic field pattern of the $TE_{011}$ mode.

FIG. 17 is a diagram showing the distribution of the electromagnetic field around a resonator R for a $TE_{011}$ type resonance mode. The magnetic field lines H are shown as fine dashed lines and the electric field lines E are shown as fine continuous lines. The geometry of the E-field and H-field are important to understanding the various methods of providing cross-coupling, as will be further described below. The $TE_{011}$ resonance mode for the resonators is advantageous when associated with the rectangular housing construction and makes it possible to obtain a filter having a Q-factor which is high, greater than 10,000.

Figure 6B:
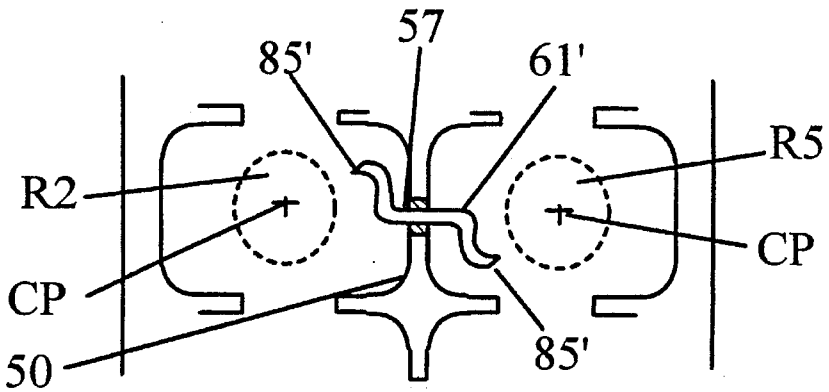
Figure 6A:
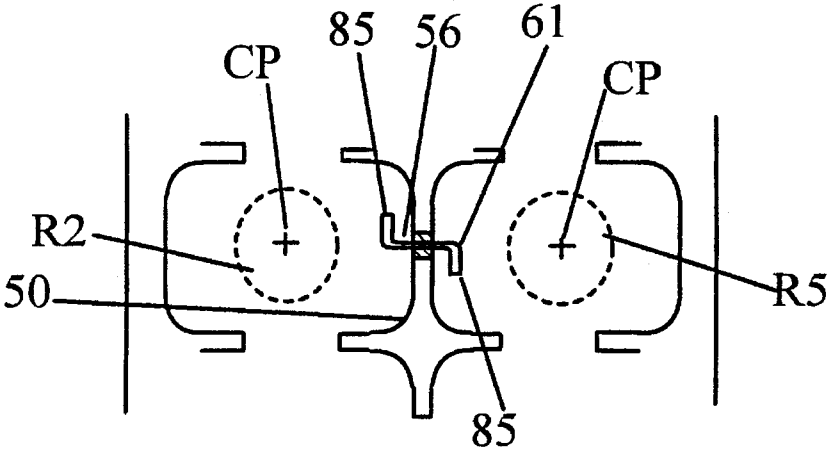

Given the distribution of the magnetic field lines as shown in FIG. 17, it should be observed that in theory the probe ends 85' and 90' of FIGS. 6B and 7B, respectively, can provide coupling more efficiently if the probes are disposed in a horizontal plane perpendicular to the magnetic flux lines H.

The coupling probes described with respect to FIGS. 5–8 are 'symmetric' couplings; that is, the effect of their presence is to introduce symmetric special features to the filtering characteristics, eg. a pair of transmission zeros symmetrically disposed about the center frequency of the filter's usable bandwidth, or group delay flattening over a centrally positioned portion of the filter's passband. Such symmetric features are achieved by coupling between two resonators which are separated by an even number of resonators in the sequence of resonators which form the main signal path through the filter. For example, the symmetric coupling probe 60 in FIG. 5 provides a cross coupling between resonators R2 and R5, these resonators having two other resonators (R3 and R4) between them in the sequential main signal path. Therefore this cross coupling will produce a symmetric feature to the filter's transfer characteristics, in this case a pair of transmission zeros symmetrically disposed on the lower and upper side of the filter's passband as seen in the measured characteristics of FIG. 9. FIG. 9 shows the two transmission zeros symmetrically disposed about the passband which are produced by the negative cross coupling probe 60, and the enhancement in near-to-band selectivity that results. The transmission zeros are the points where the plot dips down to points near the horizontal axis (near the −20.000 and 30,000 MHz marks).

When there are an odd number of resonators in the main signal path separating the two resonators coupled by any of the cross couplings, the probes in FIGS. 5–8, asymmetric features are introduced in the filter's rejection or group delay characteristics. The asymmetric features may take the form of one or more transmission zeros located on one side of the filter's passband only, or asymmetrically disposed on either side of the filter's passband only, or asymmetrically disposed on either side of the filter's passband. With this asymmetric disposition of transmission zeros the slopes of the filter's rejection characteristics will be different on the lower and upper sides of the filter's passband. Such asymmetric features are useful for satisfying desired specifications for rejection which are different on the lower and upper sides of asymmetry in the group delay characteristic of the filter. For example, it may be desirable to have a slope in the group delay across a portion of the passband of the filter, adjusted to counteract an opposite-going slope that is caused by dispersion characteristics of the dielectric resonator. The cancellation of the dispersive group delay slope with the slope caused by the asymmetrical cross coupling results in the desired flat group delay over the central portion of the filter's passband. If the dispersive group delay slope was not compensated for, distortion to the signal passing through the filter would occur.

In the present invention, a convenient way to implement the asymmetric cross couplings is diagonally through the corners of the cavities to be cross coupled, hence the alternative name diagonal cross coupling for the asymmetric coupling. FIGS. 10A, 10B and 10C show cross coupling probes which couples resonators R2 and R4, thereby producing asymmetric features to the filter's characteristics.

Figure 18A:
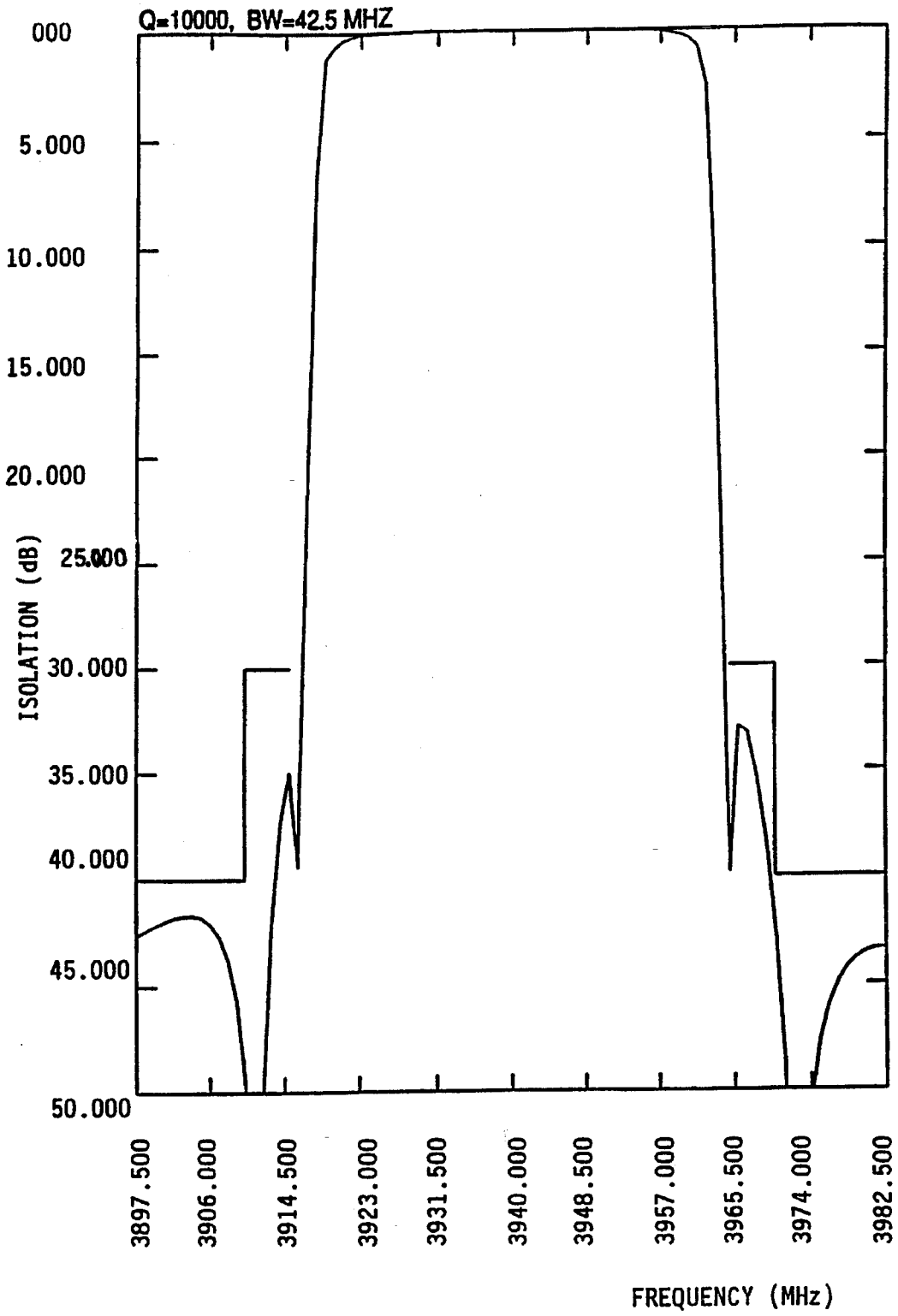
FIGS. 18A, 18B and 18C are plots of simulations of the output of the filter shown in FIGS. 11–14.
Figure 18B:
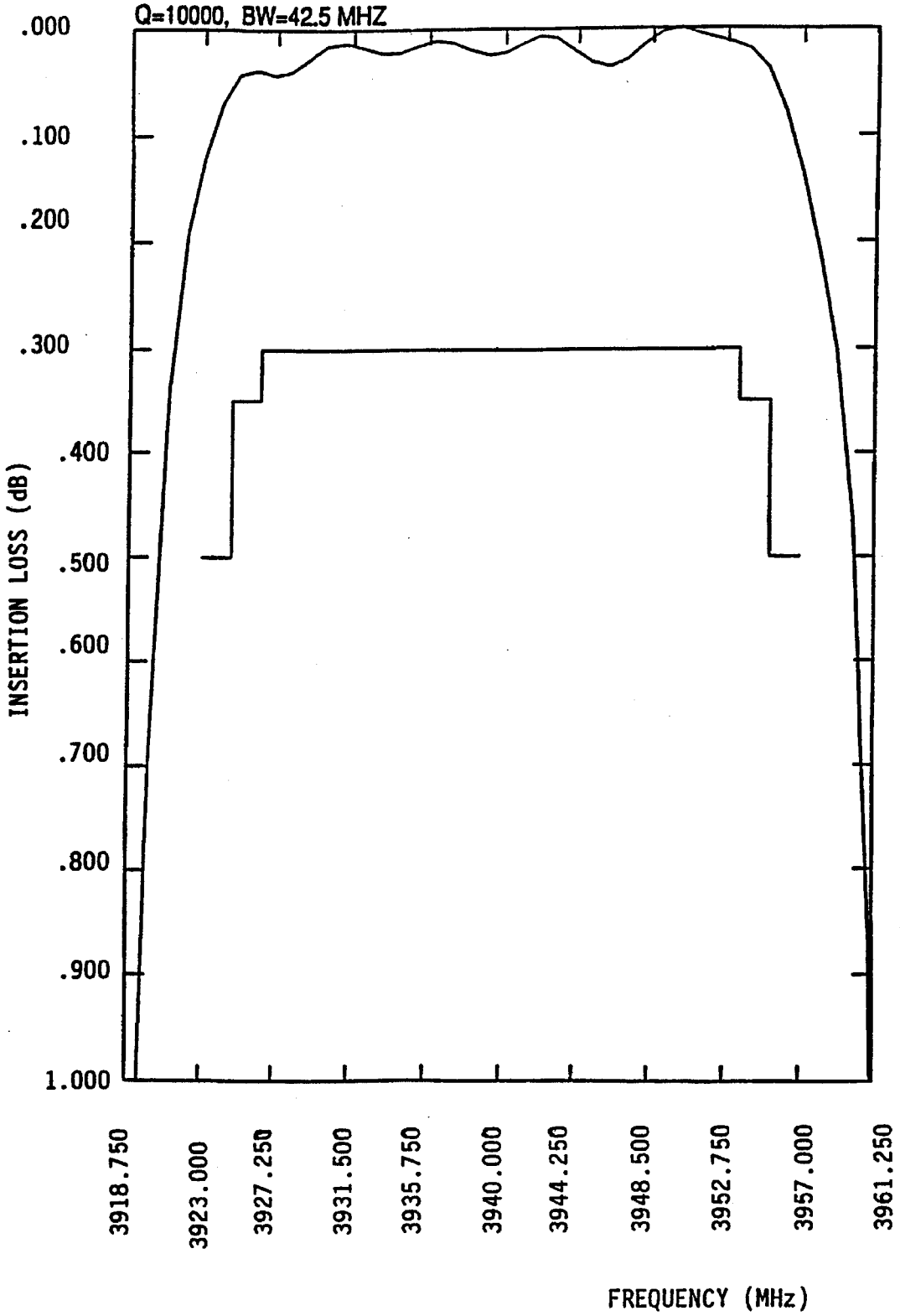
Figure 18C:
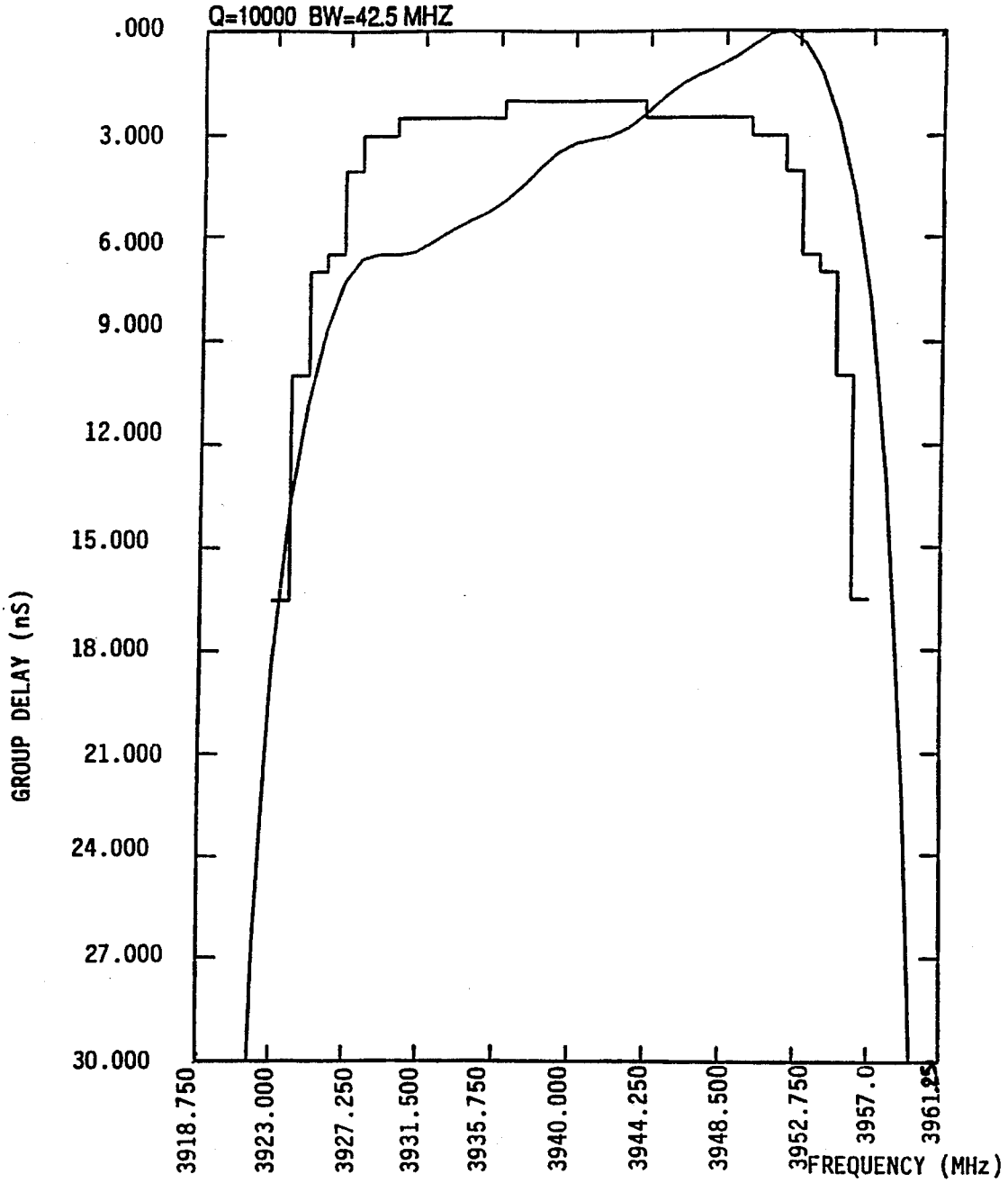
Figure 19A:
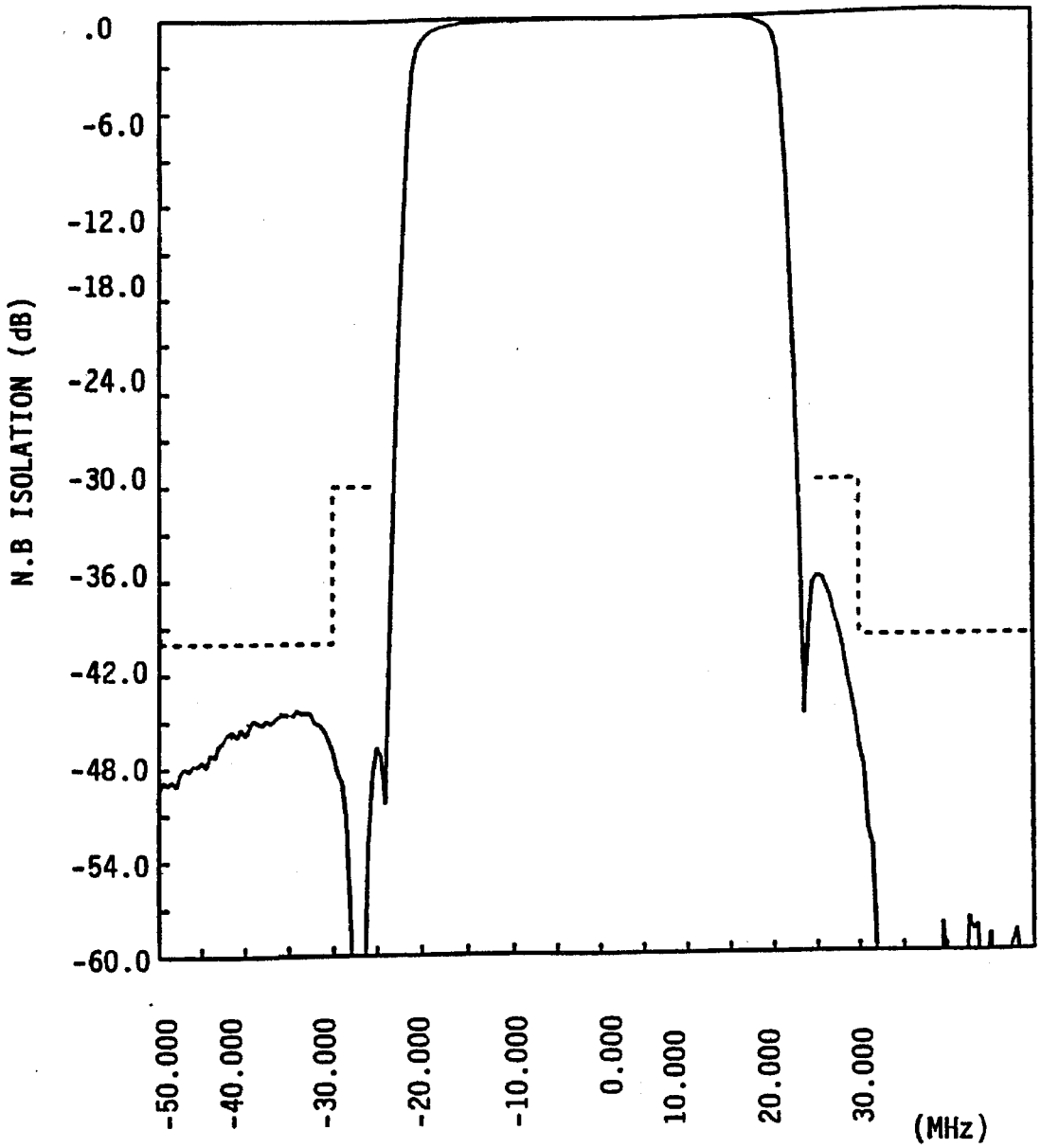
FIGS. 19A and 19B are plots of the measured output of the filter shown in FIGS. 11–14.
Figure 19B:
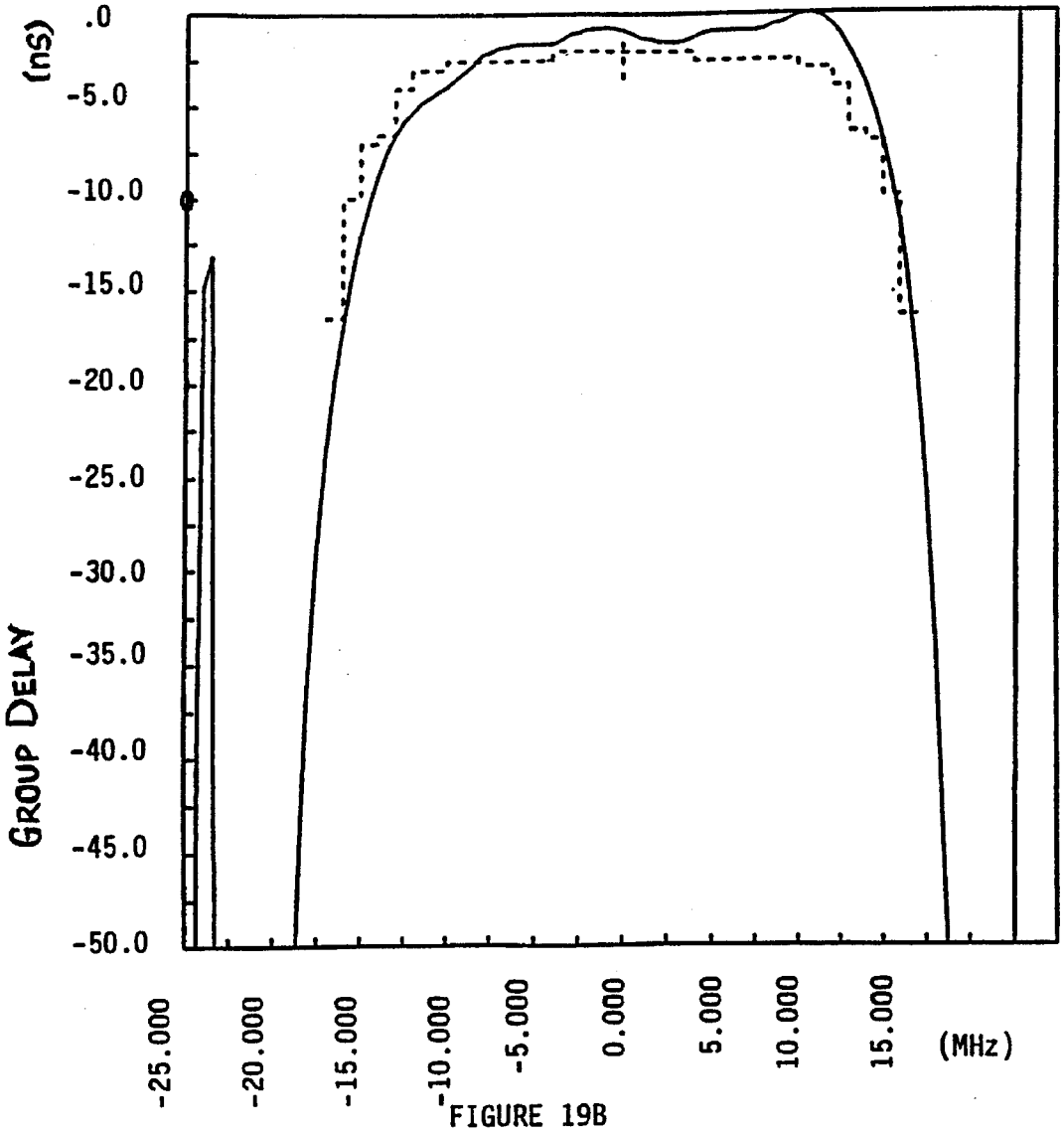

A series of simulated performance plots based upon a mathematical analysis of the 10th degree filter (depicted in FIGS. 11–14) is shown in FIGS. 18A, 18B and 18C. The square lines on the plots indicate the upper or lower bounds of a typical desired output, and the curves indicate the simulated outputs. FIGS. 19A and 19B are plots of measured responses to the filter depicted in FIGS. 11–14. In some applications, the output may be acceptable.

Figure 20A:
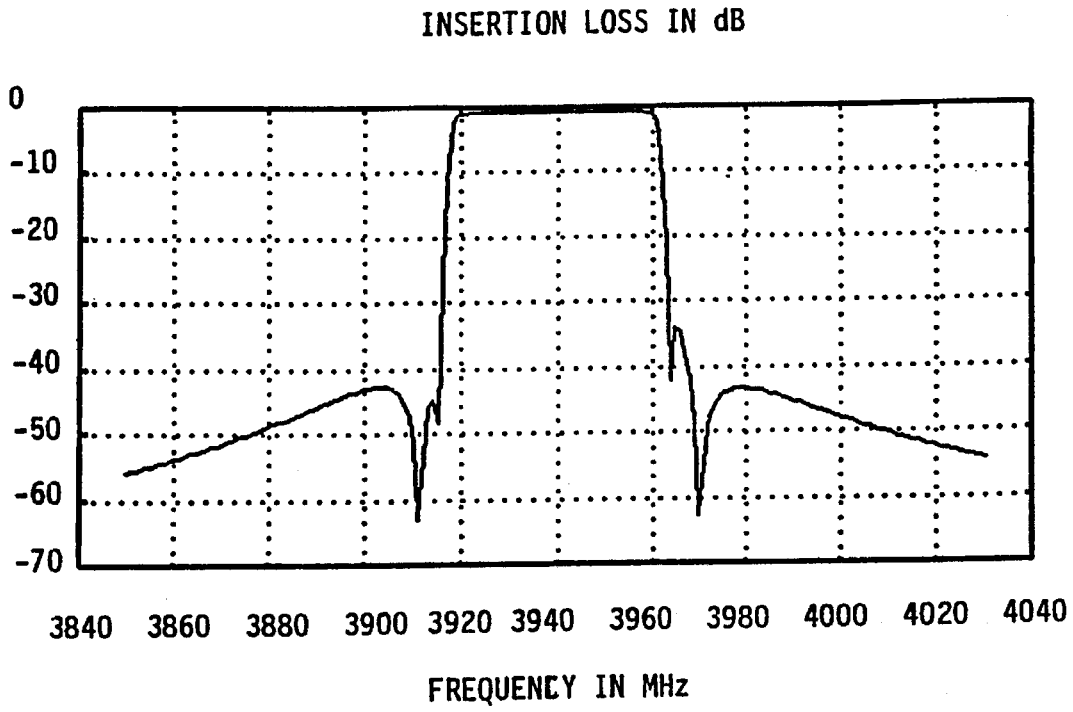
FIGS. 20A and 20B are plots of simulated outputs of the filter shown in FIG. 15.
Figure 20B:
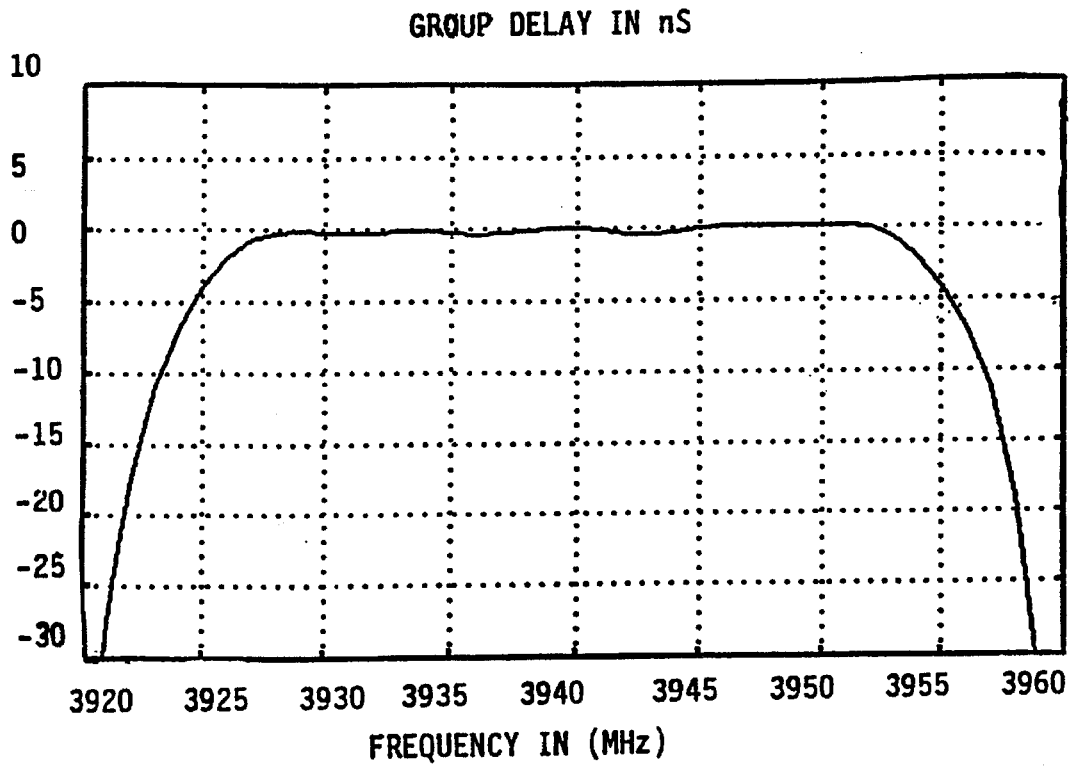

However, the addition of cross-diagonal couplings, such as those described with respect to the filter depicted in FIG. 15 provides an improved response over the plots in FIGS. 19A and 19B. For instance, the FIGS. 20A and 20B are simulations of outputs from the filter depicted in FIG. 15, based upon a theoretical analysis of the filter configuration. Measured outputs yielded the plots shown in FIGS. 21A and 21B, confirming that the filter in FIG. 15 provides improved response with cross-diagonal coupling. The filter's special features (enhanced selectivity, flattened group delay) are caused by the combined action of the cross-coupling between adjacent non-sequential filter resonators, and coupling between non-sequential, non-adjacent resonators.

Figure 21A:
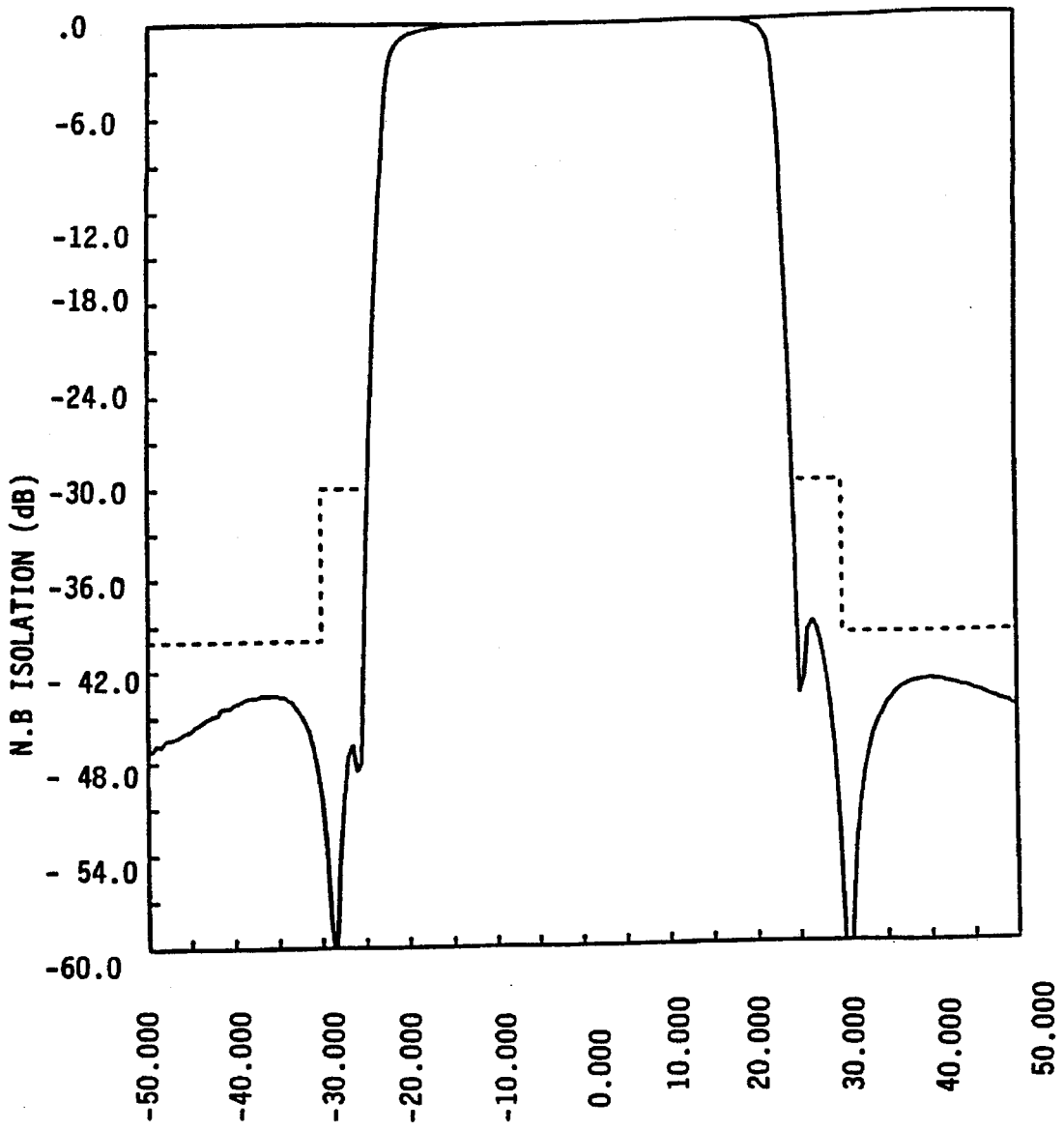
FIGS. 21A and 21B are plots of measured outputs of the filter shown in FIG. 15.
Figure 21B:
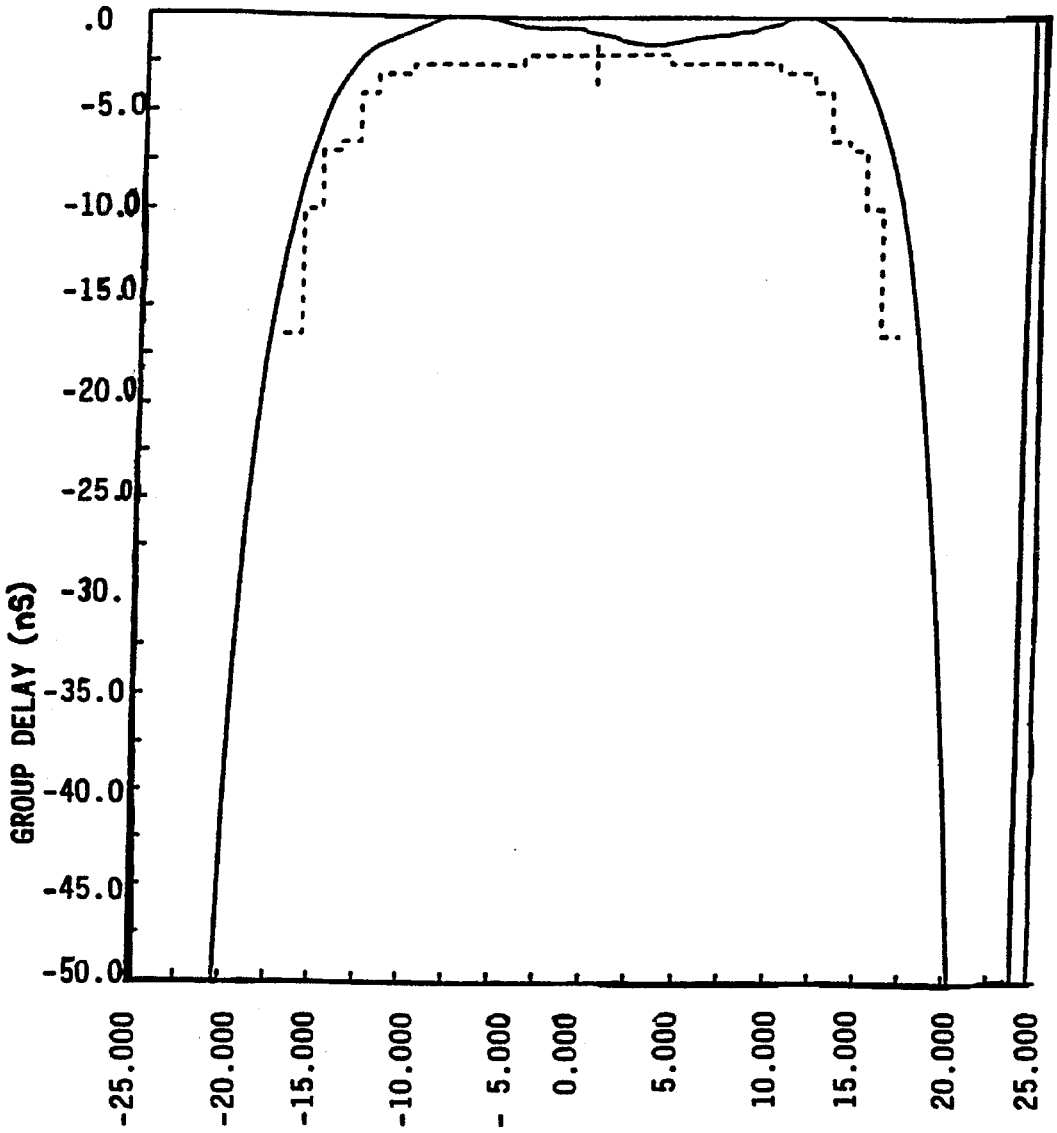

As is demonstrated by the measured output of the filter depicted in FIGS. 11–14, the plot in FIG. 19A does provide the desired isolation (the desired isolation is depicted in dashed lines, the measured output is solid). However, the group delay output shown in the plot in FIG. 19B has a slope that is partially below the desired output (the desired output is in dashed lines, the measured is solid). The slope at the top of the plot in FIG. 19B is generally attributable to the dispersion characteristic of the dielectric resonators. However, the characteristics of the filter can be predistorted by the addition of cross diagonal coupling of at least one pair of non-sequential, non-adjacent (or contiguous) cavities, as is depicted in the filter shown in FIG. 15. Indeed, the output measured from the filter depicted in FIG. 15, as plotted in FIGS. 21A and 21B shows that the measured output of the filter is well within the desired output requirements. The cross diagonal coupling distorts the filter depicted in FIG. 15 to counteract the dispersion characteristic of the dielectric resonators and yield an output curve that is above the desired output (dashed lines in FIG. 21B).

The invention is not limited to the embodiments described herein, thus, for example, the number of resonators may be different from 6 or 10 and may be equal to an odd number. e.g. 5, 7, 9, . . . etc.

While the invention has been described in conjunction with various preferred embodiments thereof, it will be understood that it is capable of further modifications. The claims are intended to cover any variation, use or adaptations of the invention which are generally consistent with the principles of the invention, and including such departures from the invention as come within known and customary practice within the art to which the invention pertains.

What is claimed:

1. A single mode microwave filter comprising:

a unitary multi-cavity housing comprised of a plurality of walls defining a plurality of cavities, that are sequentially oriented in first and second side-by-side rows, each row having a plurality of cavities;

a plurality of cylindrically shaped dielectric resonators, a respective dielectric resonator disposed in each of said cavities, the walls between adjacent sequential cavities being provided with coupling means for coupling adjacent sequential resonators;

an input device disposed adjacent to and connected to a first cavity in said first row;

an output device disposed adjacent to and connected to a cavity in said second row;

a first probe disposed in the wall between two adjacent non-sequential cavities, one cavity of said two adjacent non-sequential cavities being in said first row and the other cavity of said two adjacent non-sequential cavities being in said second row thus cross coupling said two adjacent cavities, said first probe having opposite first probe ends, said first probe ends extending into respectively said two adjacent non-sequential cavities to couple radiant energy therebetween;

a second probe disposed in said walls, said second probe having second probe ends that extend into respectively two contiguous non-adjacent non-sequential cavities to couple radiant energy therebetween.

2. A filter as set forth in claim 1 wherein said first probe ends are symmetrical about said wall between said adjacent cavities.

3. A filter as set forth in claim 2 wherein the coupling means for coupling adjacent sequential resonators are respective slots located in corresponding said walls between adjacent sequential cavities, said respective slots coupling resonant energy between said adjacent sequential resonators, each slot coupling being mathematically defined as positive, and said symmetrical probe ends of said first probe couple energy between said resonators in said two non-sequential adjacent cavities, said first probe coupling being mathematically defined as negative.

4. A filter as set forth in claim 3 wherein said first probe ends are asymmetrical about said wall between said two non-sequential adjacent cavities.

5. A filter as set forth in claim 4 wherein the respective slots located in said corresponding walls couple resonant energy between said adjacent sequential resonators, said respective slot coupling defined mathematically as positive and said asymmetrical probe ends of said first probe couple energy between said adjacent cavities, said first probe coupling being defined mathematically as positive.

6. A filter as set forth in claim 1 wherein said walls define at least ten cavities, each row containing five cavities, the first and second probe ends each having a respective shape that generally follows a curved surface of the corresponding resonators located in the two adjacent non-sequential cavities containing the respective first and second probe ends.

7. A microwave filter comprising:

a housing comprised of a plurality of walls defining at least first and second cavities, wherein at least one of said walls is provided with a respective slot which provides communication between said first cavity and said second cavity;

a respective fin pivotally supported along a central axis by said housing and disposed for rotation around said central axis within said corresponding slot for variably obstructing the respective slot opening and thereby adjusting a corresponding coupling between said first cavity and second cavity;

a plurality of cylindrically shaped dielectric resonators, a respective dielectric resonator disposed in each of said cavities;

an input device disposed adjacent to and connected to one of said cavities;

an output device disposed adjacent to and connected to another of said cavities.

8. A single mode microwave filter comprising:

a unitary multi-cavity housing comprised of a plurality of walls defining a plurality of cavities, the cavities sequentially oriented in first and second side-by-side rows, each row having a plurality of cavities with a respective common wall between sequential cavities, each common wall between sequential cavities having a respective slot therein;

a plurality of cylindrically shaped dielectric resonators, a respective dielectric resonator disposed in each of said cavities;

an input device disposed adjacent to and connected to a first cavity in said first row;

an output device disposed adjacent to and connected to a last cavity in said second row;

at least one fin supported by said housing, disposed in at least one of the slots for adjusting a size of the respective slot, said respective fin having a size which is smaller than said respective slot and said respective fin being located so that it does not contact a periphery of said corresponding slot.

9. A filter as set forth in claim 8 further comprising:

a probe having at least two probe ends, said probe being disposed in said housing between non-adjacent, non-sequential cavities, said probe ends extending into said non-adjacent, non-sequential cavities and alongside a cylindrical surface of said corresponding cylindrically shaped resonators.

10. A filter as set forth in claim 8 further comprising:

a probe disposed in the wall between at least two non-sequential adjacent cavities, one cavity of said at least two non-sequential adjacent cavities being in said first row and the other cavity of said at least two non-sequential adjacent cavities being in said second row thus cross coupling said at least two non-sequential adjacent cavities, said probe having respective probe ends which extend alongside a cylindrical surface of the corresponding cylindrically shaped resonators.

11. A probe for use in a microwave filter, said filter having a plurality of walls defining at least four cavities, each cavity being loaded with a respective cylindrically shaped dielectric resonator therein, said probe comprising:

a body portion;

two probe ends attached to said body portion, said body portion being positionable at an intersection of at least two walls such that each of said probe ends are capable of being disposed in separate, contiguous, nonadjacent, non-sequential cavities and each of said probe ends are capable of extending alongside a respective cylindrical surface of the corresponding adjacent resonator and are capable of being spaced apart therefrom, and is capable of conforming to a curve of the respective resonator, each of said probe ends capable of being asymmetrical about said body portion.

12. A probe according to claim 11, wherein said probe has an 'S' shape.

* * * * *